US005685944A

United States Patent [19]

Nose et al.

[11] Patent Number: 5,685,944

[45] Date of Patent: Nov. 11, 1997

[54] FILM TRANSFER APPARATUS AND A FILM TRANSFER ROLLER USED THEREIN

[75] Inventors: Masahisa Nose; Hiroshi Kozaki; Kazuhiro Tanaka; Masahiko Ono; Kazuya Watanabe; Makoto Ohtani; Keiichiro Minegishi, all of Osaka, Japan

[73] Assignee: Fujicopian Co., Ltd., Japan

[21] Appl. No.: 429,319

[22] Filed: Apr. 26, 1995

[30] Foreign Application Priority Data

| | | | |
|---|---|---|---|
| Apr. 28, 1994 | [JP] | Japan | 6-090893 |
| Jul. 29, 1994 | [JP] | Japan | 6-177780 |
| Aug. 19, 1994 | [JP] | Japan | 6-195095 |
| Oct. 4, 1994 | [JP] | Japan | 6-239933 |

[51] Int. Cl.[6] ..... B32B 31/00

[52] U.S. Cl. ..... 156/540; 156/577; 156/578; 156/579

[58] Field of Search ..... 156/540, 574, 156/579, 577, 578, 184

[56] References Cited

U.S. PATENT DOCUMENTS

| | | | |
|---|---|---|---|
| 4,718,971 | 1/1988 | Summers | 156/540 |
| 4,787,955 | 11/1988 | Nagel | 156/577 |
| 5,472,560 | 12/1995 | Horng | 156/540 |

FOREIGN PATENT DOCUMENTS

| | | |
|---|---|---|
| 0380977 | 8/1990 | European Pat. Off. . |
| 0380978 | 8/1990 | European Pat. Off. . |
| 0427870 | 5/1991 | European Pat. Off. . |
| 0551522 | 7/1993 | European Pat. Off. . |
| 0619189 | 10/1994 | European Pat. Off. . |
| 3911402 | 10/1990 | Germany . |
| 4217295 | 12/1993 | Germany . |
| 2-2611 | 1/1990 | Japan . |
| 4-126878 | 11/1992 | Japan . |

*Primary Examiner*—Jay H. Woo
*Assistant Examiner*—Joseph Leyson
*Attorney, Agent, or Firm*—Webb Ziesenheim Bruening Logsdon Orkin & Hanson, P.C.

[57] ABSTRACT

A film transfer apparatus includes an apparatus casing having a feed-core support shaft for detachably mounting a feed core and a take-up core support shaft for detachably mounting a take-up core. The support shafts respectively include a transmission member for causing the feed core to provide a film ribbon take-up speed higher than a ribbon feed speed of the feed core. For slippably coupling the feed core rotation and the take-up core rotation, a slip coupling mechanism is provided. This mechanism is constituted by an engaged portion of the take-up core for engagement with a mating engaging portion of the take-up core support shaft. The engaged portion is elastically deformable to a non-transmission condition with application thereto of a force exceeding a predetermined level. Further, the engaged portion is provided with a mechanical strength smaller than the engaging portion.

6 Claims, 18 Drawing Sheets

FILM TRANSFER APPARATUS AND A FILM TRANSFER ROLLER USED THEREIN

BACKGROUND OF THE INVENTION

The present invention relates to a film transfer apparatus and a film transfer roller used therein.

DESCRIPTION OF THE RELATED ART

With a film transfer apparatus, a feed roller and a take-up roller are coupled with each other via gears so that the take-up roller is rotated at a film take-up speed higher than a film feeding speed provided by rotation of the feed roller. In operation, while the feed roller is rotated to feed a transfer film ribbon, the take-up roller is rotated to take up the used transfer ribbon thereon after its passage through a transfer head. A slip arrangement is provided between the feed roller rotation and the take-up roller rotation, such that the take-up speed provided by the take-up roller higher than the feeding speed provided by the feed roller will not provide the transfer ribbon with excessive tension while allowing smooth take-up of the used ribbon onto the take-up roller without slackness in the ribbon.

According to the conventional art, as shown in FIGS. 39 and 40, an apparatus casing C' integrally forms two fixed tubular shafts 151, 152. One shaft 151 rotatably mounts a feed-core support shaft 154 for engaging and retaining a feed core 153. The feed-core support shaft 154 includes a tubular element 154A, and at four peripherally spaced positions in an outer peripheral surface of the tubular element 154A, triangular engaging portions 154*a* are integrally formed for selective engagement with corrugations of a corrugated engaged portion 153*a* formed in an engaging inner peripheral surface of the feed core 153. Further, on peripherally opposed sides across the respective engaging portions 154*a*, there are formed slits 154*b* extending along the rotational axis of the feed core 153 for allowing radially inward elastic deformation of each engaging portion 154*a* to a non-transmission position when a relative rotational force exceeding a predetermined magnitude is generated between the feed-core support shaft 154 and the feed core 153. Hence, the engaging portions 154*a* capable of the radially inward elastic deformation constitute a slip coupling mechanism 155.

On the other hand, the other fixed tubular shaft 152 detachably mounts a take-up core 156. The feed-core support shaft 154 and the take-up core 156 integrally and respectively form gears 157, 158 for coupling the feed core 153 with the take-up core 156 in such a manner that the take-up core 156 provides a ribbon take-up speed higher than a ribbon feeding speed provided by the feed core 153 (see, for example, Japanese laid-open utility model gazette Hei. 4-126878).

With the above-described conventional film transfer apparatus, the respective engaging portions 154*a* of the feed-core support shaft 154 capable of providing the radially inward elastic deformation act also as the slip coupling mechanism 155. Thus, no special components are needed for forming this slip coupling mechanism 155, so that both component costs and assembly steps may be reduced. However, every time when an excessive tension is applied to the transfer ribbon R in association with rotation of the take-up core 156, each engaging portion 154*a* is elastically deformed radially inwards from its portion corresponding to a lower end of the slit 154*b* adjacent thereto. Then, with repeated elastic deformations, there occurs permanent radially inward deformation in the engaging portion 154*a*. As a result, there occurs inadvertent reduction in the slippage torque initially set for allowing relative rotation between the feed core 153 and the feed-core support shaft 154, thus tending to invite a failure in take-up operation of the used transfer ribbon.

Especially, in recent years, there has been a need for possibility of repeated use of the apparatus casing C' which is generally expensive because of the inclusion of such components as the gears 157, 158, by replacement of the feed core and the take-up core, when the entire transfer ribbon entrained about the feed and take-up cores has been used. In this respect, according to the above-described conventional art, since the permanent deformation occurs in the respective engaging portions 154*a* of the feed-core support shaft 154 provided to the apparatus casing C' through their use, the apparatus casing C' per se needs to be replaced after a short period of time.

The present invention attends to the above-described state of the art and its primary object is to provide an improved film transfer apparatus which allows repeated and long-time use of the expensive apparatus casing including such components as gears through simple yet effective modification of the take-up core or the feed core constituting the slip coupling mechanism, without inviting increase in the components costs or assembly steps required for the slip coupling mechanism. The invention also provides an improved film transfer roller for use in this film transfer apparatus.

SUMMARY OF THE INVENTION

For accomplishing the above-noted object, according to a film transfer apparatus relating to the present invention, the apparatus comprises:

- a film transfer ribbon having a transfer film on one side thereof;
- a transfer head;
- a feed core about which the film transfer ribbon is entrained with the transfer film oriented outside;
- a take-up core for taking up the film transfer ribbon fed from the feed core past the transfer head;
- an apparatus casing for replaceably accommodating therein the feed core and the take-up core, the casing including at least either a feed core support shaft for rotatably mounting the feed core with the feed core dismountable in a direction of width of the ribbon or a take-up core support shaft for rotatably mounting the take-up core with the take-up core dismountable in the direction of the ribbon width;
- a pair of transmission means provided respectively to the feed core support shaft and the take-up core support shaft or to the feed core support shaft and the take-up core for causing the take-up core to provide a ribbon take-up speed higher than a ribbon feeding speed provided by the feed core; and
- a slip coupling mechanism for slippably coupling rotation of the take-up core and rotation of the feed core.

In response to movement of the transfer head from an upstream side in a ribbon feeding direction of the feed core with the transfer head pressing the film transfer ribbon against an object surface, the feed core is rotated to continuously feed the film transfer ribbon while a portion of the ribbon past the transfer head is taken up about the take-up core.

Then, an engaged portion formed in an inner peripheral engaging surface of the take-up core for engagement with an engaging portion formed in an outer peripheral engaging surface of the take-up core support shaft or an engaged portion formed in an inner peripheral engaging surface of the feed core for engagement with an engaging portion formed in an outer peripheral engaging surface of the feed core support shaft is rendered elastically deformable to a non-transmitting position responsive to a relative rotational force exceeding a predetermined level applied thereto. This elastically deformable engaging portion constitutes the slip coupling mechanism. Further, the engaged portion of the take-up core or of the feed core is provided with a mechanical strength lower than the engaging portion of the take-up core support shaft or of the feed core support shaft.

With this construction, when an excessive tension is applied to the transfer film ribbon in association with rotation of the take-up core, there occurs slippage between the take-up core rotation and the feed core rotation, due to the elastic deformation to the non-transmitting position in the engaged portion of the take-up core engaging the engaging portion of take-up core support shaft or of the engaged portion of the feed core engaging the engaging portion of the feed-core support shaft. Thus, it is possible to reduce the number of components constructing the slip coupling mechanism.

In addition, because the engaged portion of the take-up core or the feed core is provided with a mechanical strength lower than the engaging portion of the take-up core support shaft or of the feed core support shaft, permanent deformation or frictional wear tends to occur earlier in the former than in the latter. However, the take-up core or the feed core having this engaged portion will be entirely replaced by a new one when the entire film transfer ribbon has been used. Thus, it will suffice for the engaged portion to properly serve its function only for the time period while the single roll of ribbon is used. And, the lower mechanical strength of this engaged portion helps restrict permanent deformation of frictional wear in the corresponding engaging portion of the take-up core support shaft or the feed core support shaft provided to the apparatus casing.

Consequently, through the above-described simple arrangement of the mechanical strength of the engaged portion of the take-up or feed core constituting the slip coupling mechanism, the construction allows repeated and long-time use of the expensive apparatus casing, without inviting increase in the components costs or manufacture assembly steps required for the slip coupling mechanism.

According to one aspect of the present invention, the feed core and the take-up core respectively are rotatably supported through one axial end thereof by a plate-like support member. The apparatus casing includes two separate case members detachably attached to each other in a direction of width of the film transfer ribbon. Each of the case members includes a reinforcing rib for contacting the plate-like support member introduced between the case members to restrict movement of the support member in the direction of ribbon width.

With the above construction, the feed core and take-up core are supported only through one axial end thereof by the plate-like support member. Then, in comparison with a box-like casing for supporting both axial ends of the cores, the construction allows a further reduction in the number of components and the assembly steps. Moreover, as the reinforcing ribs of the two separate case members restrict movement of the plate-like support member in the ribbon width direction through the respective contact therewith, the construction requires no special restricting components separately.

As a result, these features further promote simplicity of the apparatus construction and reduction of manufacture costs.

According to a still further aspect of the invention, a tooth of at least one of the pair of transmission means is rendered elastically deformable to a non-meshing position in response to the relative rotational force exceeding the predetermined level applied thereto. This elastically deformable tooth portion constitutes the slip coupling mechanism.

With the above construction, the slip coupling mechanism for allowing slippage due to its elastic deformation to the non-transmitting position in response to a relative rotational force exceeding a predetermined level is comprised of the tooth of one of the pair of transmission means for causing the take-up core to provide a ribbon take-up speed higher than a ribbon feeding speed provided by the feed core. Thus, this construction does not require any special elements except for the tooth portion, for forming the coupling mechanism. Further, as the construction is not affected by such dimensional factors as the inner diameter of the feed core or the take-up core, the construction allows freedom in designing of the length of the tooth portion from its tooth crest to its tooth root of the slip coupling mechanism and a radius of friction from its rotational axis to the meshing position of the tooth.

As a result, the slip coupling mechanism may be simply formed. Also, due to the freedom in designing of the length of the tooth from its tooth crest to its tooth root of the slip coupling mechanism and a radius of friction from its rotational axis to the meshing position of the tooth. the construction allows greater freedom in the setting of slip torque, reduces the load generated by the slippage and eases restriction in the manufacture precision. Consequently, this construction provides further advantages in the designing, manufacture and costs of the apparatus.

Preferably, the tooth of the transmission means constituting the slip coupling mechanism is elastically deformable to the non-meshing position which is located on the downstream side in the rotational direction in response to the relative rotational force exceeding the predetermined level applied to the pair of transmission means.

According to the above, the direction of the elastic deformation of the tooth portion constituting the slip coupling mechanism is rendered substantially the same as the torque transmitting direction of the pair of transmission means. Therefore, compared with a construction in which the elastic deformation of the tooth portion of the slip coupling mechanism takes place in a direction different from the torque transmitting direction of the transmission means, the above construction allows a same amount of torque to be obtained with a lower load.

Consequently, because of the lower load generated with the slippage, durability of the transmission means, such as gears, may be improved.

According to a still further aspect of the present invention, of the two cores and the transfer head, at least the two cores are rotatably supported on the plate-like support member to together constitute a ribbon cassette; and the apparatus casing includes a feed core support portion and a take-up core support portion for rotatably supporting one end of the respective cores in the ribbon width direction when the ribbon cassette is detachably attached to the apparatus casing.

With the above-described construction, by replacing the ribbon cassette alone, the used film transfer ribbon may be replaced by an un-used, i.e. new film transfer ribbon. Further, the apparatus casing includes the core support portions for the two cores. Hence, only by temporarily attaching the two cores to the support member ready for attachment to the apparatus casing, when this support member is attached to the casing, the two cores may be supported in a reliable manner. Thus, it is not necessary to construct the support member in the form of box for supporting both ends of the cores.

As a result, this construction provides the economic advantage of allowing repeated use of the apparatus casing with replacement of the ribbon cassette alone. In addition, the construction allows simplicity in the construction of the support member, thus achieving a reduction in the number of components and in the number of manufacturing steps required. So that, the film transfer apparatus having this construction provides an advantage in running costs.

Preferably, the one transmission means whose tooth portion constitutes the slip coupling mechanism is formed integrally with the take-up core.

With the above construction, as the tooth of the one transmission means is rendered elastically deformable, there necessarily occurs deterioration in the durability of this deformable tooth of the one transmission means as compared with a corresponding tooth of the other transmission means, so that the former transmission means needs to be replaced periodically. In such case, as this one transmission means is formed integrally with the take-up core which is to be also replaced together when the used ribbon is replaced by a new one, this transmission means and the take-up core may be replaced at one time.

As a result, the construction achieves the advantage of avoiding failure in the ribbon take-up operation due to variation in the slip torque when a user forgets to replace the one transmission means and the further advantage of facilitating the replacement operation.

According to a still further aspect of the invention, of the two transmission means, the other transmission means is formed integrally with the feed core and the one transmission means is formed integrally with the take-up core.

With this construction, the coupling mechanism extending from the feed core to the take-up cope and including also the slip coupling mechanism may be formed of only two components.

Consequently, through the reduction in the number of components required, the assembly operation may be further facilitated.

According to a still further aspect of the present invention, the apparatus casing includes a case body portion and a case lid portion which are pivotably opened and closed relative to each other via a hinge portion in the direction of ribbon width. And, the apparatus further comprises a lock member for releasably locking the two case portions at the closed position.

Still preferably, the two case portions and the hinge portion are integrally formed of synthetic resin material, and opened ends of peripheral walls of the respective case portions include engagement regulating portions which are engageable with each other in the ribbon width direction when the two case portions are pivotably closed, so as to restrict relative movement between the peripheral walls along thickness thereof.

With the above construction, the case body portion, the case lid portion and the hinge portion are integrally formed together of synthetic resin material. Thus, this construction allows to eliminate an assembly step otherwise needed for pivotably connecting the case body portion and the case lid portion so be opened and closed relative to each other.

Furthermore, due to contraction occurring in the course of integral molding of the two case portions, a declining deformation may occur in the peripheral walls of the two case portions, so that, when the two case portions are pivoted to be closed, a mis-alignment may occur between the abutment portions of the opening ends of the peripheral walls of the case portions in the direction of the wall thickness. In this case, according to the above construction, the mis-alignment may be forcibly corrected through the engagement between the engagement regulating portions provided at the open ends of the peripheral walls of the two case portions. Consequently, it is possible to restrict formation of a stepped gap between the abutment portions of the open ends of the peripheral walls of the case portions.

As a result, the construction further facilitates the manufacture of the apparatus casing and reduces the manufacture costs of the entire apparatus. In addition, the construction may contribute to aesthetic improvement of the apparatus by elimination of stepped gab between the open ends of the peripheral walls of the two case portions.

According to a still further aspect of the invention, the peripheral wall of one of the case portions integrally forms a guiding projection for guiding the peripheral wall of the other case portion to the position of engagement between the engagement regulating portions when the two cases are pivotably closed to each other.

With this construction, when a declining deformation is present in the peripheral walls of the case portions, in association with the pivoting operation of the case portions to the closed position, the guiding projection formed integrally with the peripheral wall of one case portion forcibly guides the peripheral wall of the other case portion correctly to the position of the engagement between the engagement regulating portions provided in the open ends of the peripheral walls of the two case portions.

As a result, when a declining deformation is present in the peripheral walls of the case portions, the peripheral walls may be properly guided to the position for engagement between the engagement regulating portions in association with the pivoting operation of the case portions to the closed position. Accordingly, this construction does not require any special operation for forcibly aligning the engagement regulating portions, thus facilitating the closing operation of the two case portions.

The present invention provides also a film transfer roller to be used in a film transfer apparatus described above. According to one aspect of the present invention, a film transfer roller comprises:

- a roller portion for transferring a transfer film attached to one side of a base of a film transfer ribbon on to an object surface by pressing the base from the other side thereof against the object surface;
- a support portion for rotatably supporting the roller portion to a bearing portion;
- wherein, the roller portion includes a roller face which is capable of radially inward elastic deformation, the roller portion being substantially tubular to provide inner space for allowing the radially inward elastic deformation of the roller face; and
- a connecting portion is provided for coaxially connecting the roller portion and the support portion, the roller portion, the support portion and the connecting portion being formed integrally with each other.

With the above construction, when transferring the film from the base to the object surface, if there occurs one-sided contact situation in which the base portion contacting the roller face becomes inclined relative to the object surface in the direction of the width of the base, the pressing force applied to the roller portion causes radially inward elastic deformation toward the inner space of the one-sided contact portion of the roller portion, so that the entire transfer film positioned adjacent the base portion contacting the transferring position of the roller surface may be pressed against the object surface.

Moreover, the roller portion having such elastically deformable roller face, the support portion and the connecting portion coaxially connecting the roller portion and the support portion may be simply fabricated by a single step, without using such conventional troublesome process as an insert molding process or press-fit process.

As a result, because of the possibility of one-step fabrication without using the troublesome process such as the insert molding process or press-fit process, it is possible to manufacture at low costs a film transfer roller which may restrict film transfer failure due to one-sided contact in the film transfer operation.

According to a still further aspect of the invention, the roller portion of the film transfer roller includes a plurality of slits extending along the rotational axis and formed at a plurality of positions along the rotational direction of the roller portion so as to form roller segments between adjacent slits, each roller segment being capable of radially inward elastic deformation.

With the above construction, the plurality of roller segments constituting the roller portion are separated from each other by the slits extending therebetween along the rotational axis. Accordingly, the adjacent roller segments will not significantly restrict the radially inward elastic deformation of the roller segment positioned therebetween.

As a result, in comparison with a construction where the roller face of the roller portion extends continuously along the rotational direction, the above construction allows a relatively large amount of radially inward elastic deformation with a same amount of pressing force in a film transfer operation. Hence, this construction may more effectively restrict occurrence of film transfer failure due to the one-sided contact phenomenon.

According to a still further aspect of the present invention, the connecting portion of the film transfer roller includes a plurality of connecting elements for connecting an inner peripheral face of the roller portion and an outer peripheral face of the support portion at a plurality of positions in the rotational direction.

With the above-described construction, the radially inward elastic deformation may occur in each intermediate portion between adjacent connecting elements of the roller face of the roller portion.

As a result, in comparison with a construction in which the connecting portion for coaxially connecting the roller portion and the support portion is formed as an annular plate member extending continuously in the rotational direction, the radially inward elastic deformation of the roller portion connected with the connecting portion may be further promoted so as to restrict more effectively occurrence of film transfer failure due to the one-sided contact phenomenon.

According to a still further aspect of the invention, each of the plurality of connecting elements is displaced to one side in the rotational direction relative to a line extending between its connecting portion with the support portion and the rotational axis.

With the above construction, when a pressing force is applied to the roller portion for transferring the film, the radially inward elastic deformation occurs also in the connecting portion coaxially connecting the roller portion and the support portion may also be elastically deformed in the radially inward direction, in addition to the portion of the roller face to which this connecting portion is connected.

As a result, the radially inward elastic deformation of the connecting portion per se serves to promote the radially inward elastic deformation of the roller face portion to which the connecting portion is connected, thereby more effectively restricting the film transfer failure due to the one-sided contact.

Further and other objects, features and effects of the invention will become more apparent from the following more detailed description of the embodiments of the invention with reference to the accompanying drawings.

DETAILED DESCRIPTION OF THE PREFERRED EMBODIMENTS

Figure 1:
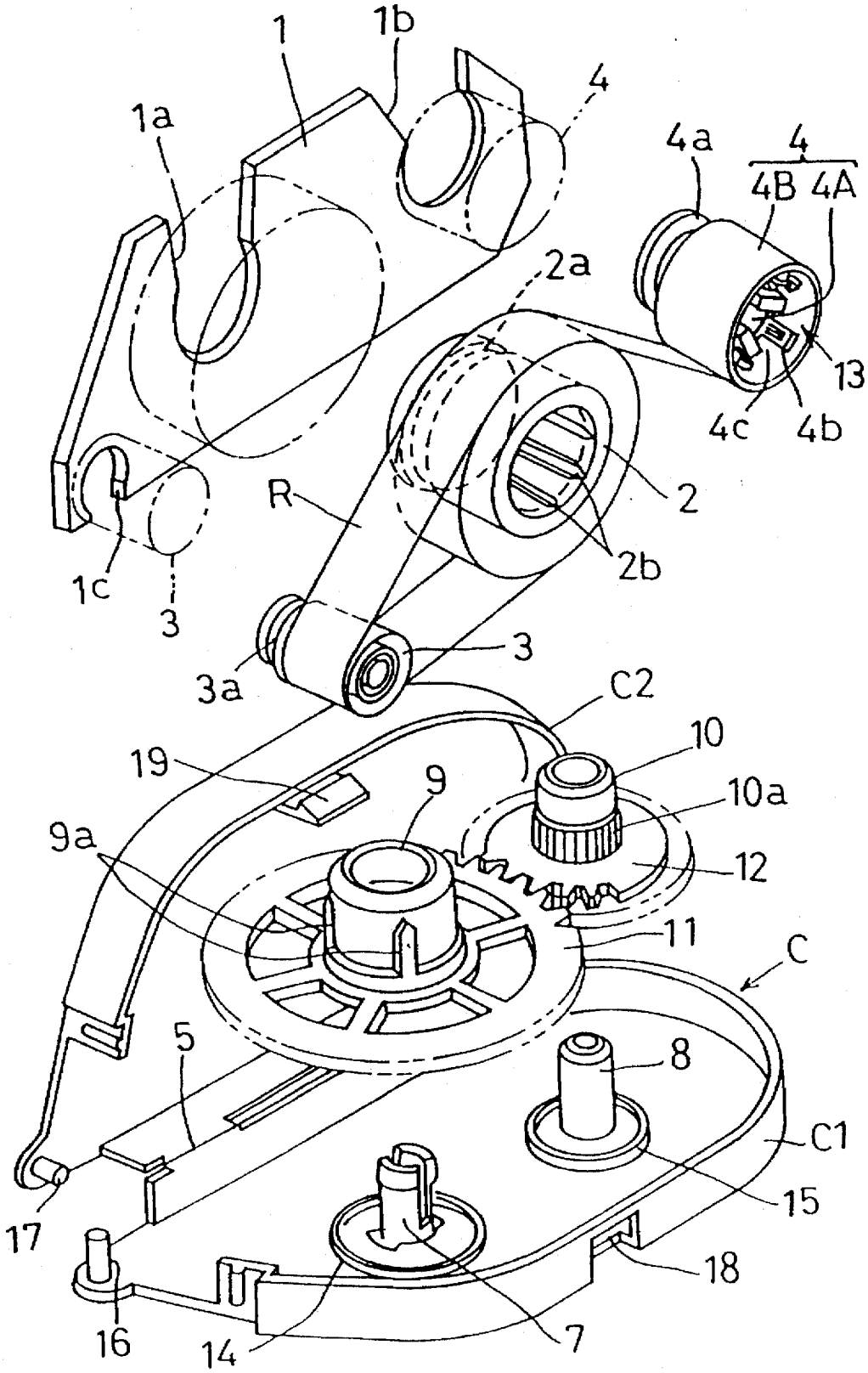
FIG. 1 is an exploded perspective view of a film transfer apparatus relating to one preferred embodiment of the present invention.
Figure 2:
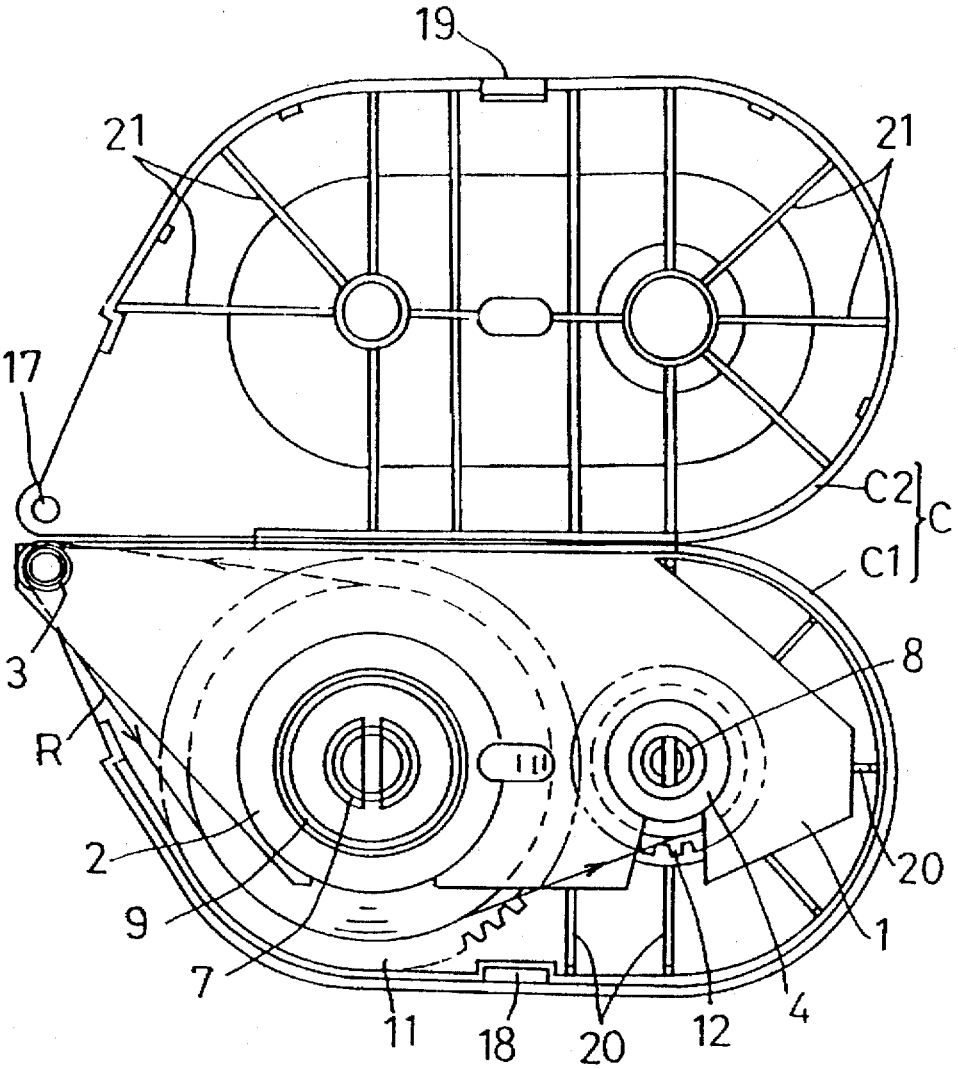
FIG. 2 is a plan view of the apparatus of FIG. 1 with an apparatus casing thereof opened.
Figure 3:
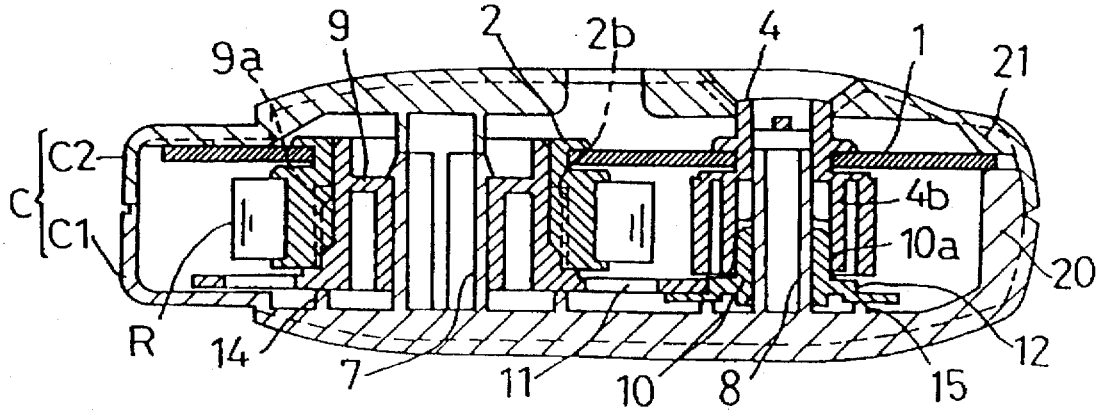
FIG. 3 is a section view of the entire film transfer apparatus shown in FIG. 1.

Preferred embodiments of a film transfer apparatus relating to the present invention will be described in details with reference to the accompanying drawings.

As shown in FIGS. 1 through 6, a film transfer apparatus includes an apparatus casing C made of resin material and a plate-like support member 1 formed of a resin or paper material to be detachably attached to the apparatus casing C. The plate-like support member 1 mounts a feed core 2 made of resin on which a film transfer ribbon R including a transfer film (a) on one side thereof is entrained with the film (a) oriented outside, a transfer roller 3 made of a resin material and acting as a transfer head for pressing the ribbon R fed from the feed core 2 against an object surface B to transfer the pressure sensitive adhesive transfer film (a) as the transfer film on to the object surface, and a take-up core 4 made of a resin material for taking up the used transfer ribbon R fed past the transfer roller 3.

The film transfer ribbon R is comprised of a resin base film (b) (about 25 μm in thickness) as an example of flexible base material and the adhesive film (about 20 μm in thickness) removably attached to one side of the base film (b).

The plate-like support member 1 has an outer configuration substantially corresponding to an inner peripheral configuration of the apparatus casing C to which this support member 1 is to be attached. Further, this plate-like support member 1 includes a first attaching hole la detachably engageable with a peripheral groove 2*a* defined at one rotational axial end of the feed core 2 for rotatably and unwithdrawably supporting the feed core 2 introduced to a predetermined position, a second attaching hole 1*b* detachably engageable with a peripheral groove 4*a* defined at one rotational axial end of the take-up core 4 for rotatably and unwithdrawably supporting the take-up core 4 introduced to a predetermined position, and a third attaching hole 1*c* detachably engageable with a peripheral groove 3*a* defined at one rotational axial end of the transfer roller 3 for rotatably and unwithdrawably supporting the transfer roller 3 introduced to a predetermined position.

The apparatus casing C includes two separate case members C1, C2 divided into two along the direction of width of the ribbon and formed integrally with each other via a hinge portion 5 to be pivotably opened and closed. One case member C1 integrally forms, as projections on its inner face, a feed-core tubular fixed shaft 7 and a take-up core tubular fixed shaft 8 with a predetermined axial distance therebetween corresponding to an axial distance between the feed core 2 and the take-up core 4. Further, the feed-core tubular fixed shaft 7 rotatably mounts thereon a feed-core support shaft 9 for detachably mounting and supporting thereon the feed core 2 along the ribbon width direction. Similarly, the take-up tubular fixed shaft 8 rotatably mounts thereon a take-up core support shaft 10 for detachably mounting and supporting thereon the take-up core 4 along the ribbon width direction.

The feed-core support shaft 9 and the take-up core support shaft 10 integrally form large and small gears 11, 12 as transmission means for coupling the feed core 2 with the take-up core 4 so that the take-up core 4 provides a ribbon take-up speed higher than a ribbon feeding speed provided by the feed core 2 even when the diameter of convolution of the transfer ribbon R on the feed core 2 becomes smaller. Further, at engaging portions of the take-up core support shaft 10 and the take-up core 4, there is provided a slip coupling mechanism 13 for slippably coupling rotation of the take-up core 4 with rotation of the feed core 2.

The case portion C1 further forms integrally a first thin annular projection 14 for contact with a lower face of the feed-core support shaft 9 mounted and supported on the feed-core tubular fixed shaft 7 and a second thin annular projection 15 for contact with a lower face of the take-up core support shaft 10 mounted and supported on the take-up core tubular fixed shaft 8, and a first receiving shaft 16 for engagement into a boss of the transfer roller 3 from one axial end thereof. The other case member C2 integrally forms a second receiving shaft 17 for engagement into the boss of the transfer roller 3 from the other axial end thereof, and an engaging projection 19 for detachable engagement with an engaging hole 18 formed in the one case member C1 for maintaining the two case members C1, C2 at a mutually closed condition. Further, each of these two case members C1, C2 integrally forms a plurality of reinforcing ribs 20, 21 for contacting and restricting movement of the plate-like support member 1 in the ribbon width direction when the member 1 is introduced between the case members C1, C2.

Figure 4:
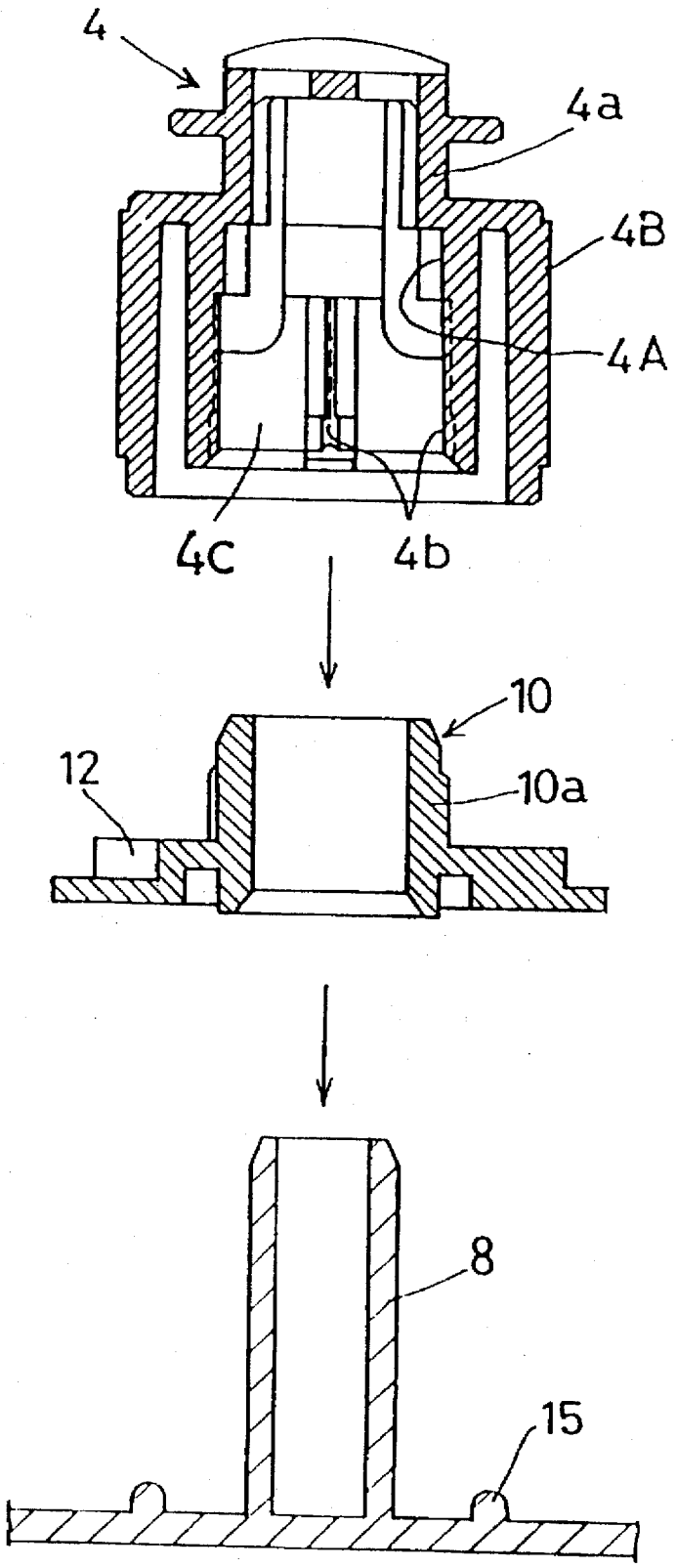
FIG. 4 is an enlarged exploded section view showing a take-up core of the apparatus of FIG. 1.
Figure 5:
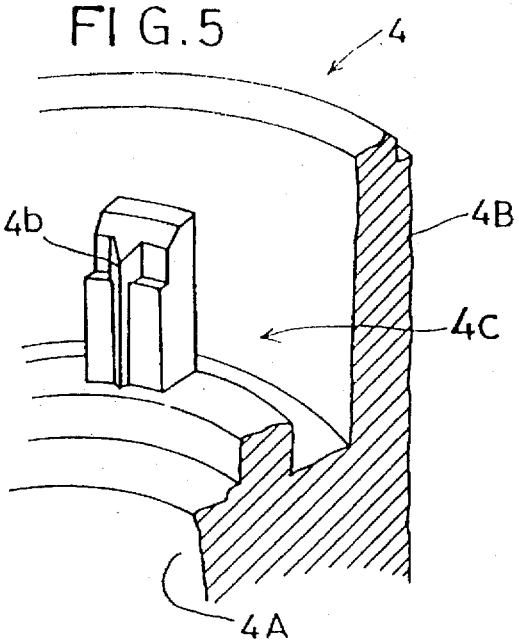
FIG. 5 is an enlarged perspective view showing one portion of an engaging inner peripheral face of the take-up core of the apparatus of FIG. 1.
Figure 6:
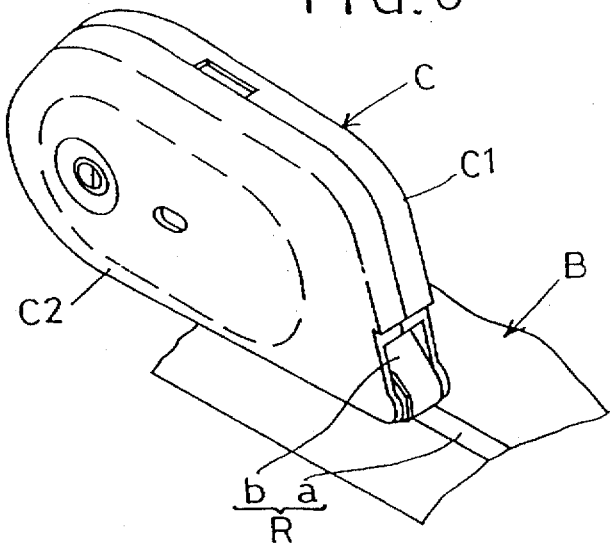
FIG. 6 is a perspective view illustrating an in-use condition of the transfer apparatus shown in FIG. 1.

As shown in FIGS. 4 and 5, the take-up cope 4 includes inner and outer tubular portions 4A, 4B, and at each of four positions spaced apart from each other with a predetermined peripheral pitch in an engaging inner peripheral face of the inner tubular portion 4A to which the take-up core support shaft 10 is to be engaged, there is projected an engaged portion **4*b* having a triangular horizontal section for selective engagement with corrugations of a corrugated engaging portion 10*a* formed in an engaging outer periphery of the take-up core support shaft 10. And, each peripheral wall portion between the adjacent engaged portions 4*b* of the inner tubular portion 4A includes a slit 4*c* for allowing elastic deformation of the engaged portion 4*b* to a non-transmitting position, i.e. a position where the engaged portion rides past a ridge of the corrugations of the engaging portion 10*a* of the take-up core support shaft 10. As described above, this engaged portion 4*b* capable of radially outward elastic deformation constitutes the slip coupling mechanism 13. Further, because of the presence of the slit 4*c* adjacent thereto, this engaged portion 4*b* of the take-up core 4 is provided with a mechanical strength smaller than a mechanical strength of the engaging portion 10*a* of the take-up core support shaft 10**.

In the engaging outer peripheral face of the feed-core support shaft 9, at each of four positions thereof spaced apart from each other with a predetermined peripheral pitch therebetween, there is integrally formed, as a projection, a narrow engaging portion **9*a* extending along the rotational axis. Further, in the engaging inner peripheral face of the feed core 2, at each of eight positions thereof spaced apart from each other with a predetermined peripheral pitch therebetween, there is integrally formed, as a projection, a narrow engaged portion 2*b* for selective engagement with the engaging portion 9*a* of the feed-core support shaft 9**.

In operation, as the film transfer ribbon R is fed in association with rotation of the feed core 2, the adhesive film (a) is transferred on to the object surface B. More particularly, first, the two case members C1, C2 of the apparatus casing C are opened. Then, the feed core 2 and the take-up core 4 supported to the plate-like support member 1 are engaged and retained respectively along the ribbon width direction on the feed-core support shaft 9 and the take-up core support shaft 10 mounted and supported on the feed-core tubular fixed shaft 7 and the take-up core tubular fixed shaft 8 of the case member C1, respectively. Thereafter, the two case members C1 and C2 are closed to each other. Then, the transfer roller 3 is rotated to the upstream side in the feeding direction of the ribbon from the feed core 2 while pressing the adhesive film (a) of the film transfer ribbon R against the object surface B, at the same time, the used ribbon R is wound onto the take-up core 4 with adhesion thereto of the side of the ribbon R to which the film (a) was adhered.

Incidentally, in the foregoing embodiment, in order to provide the engaged portions **4*b* of the take-up core 4 with the mechanical strength smaller than the mechanical strength of the corresponding engaging portion 10*a* of the take-up core support shaft 10, the slits 4*c* are formed, as cutouts, in the take-up core 4, as described hereinbefore. That is, this construction employs such configurative means as above for providing a mechanically weaker portion due to its configuration there stress tends to be applied in a concentrated manner in association with repeated elastic deformations from each generation of excessive tension applied to the ribbon R with rotation of the take-up core 4. However, instead of such configurative means, it is conceivable also to form the take-up core 4 per se of a resin material which is more vulnerable to wear than the material forming the take-up core support shaft 10**.

More particularly, adhesive wear in general may be expressed by a following expression 1; namely, $$V = K \cdot \frac{W}{H} \cdot L \qquad \text{(expression 1)}$$

where, V: wear volume, W: load, H: hardness, L: slip distance, K: proportional constant.

The adhesive wear of a materiel is in inverse proportion to the hardness thereof. Thus, by forming the take-up core 4 per se of such resin material of lower hardness than the material of the take-up core support shaft 10, the engaged portions **4*b* of the take-up core 4 may be provided with smaller mechanical strength than that of the engaging portion 10*a* of the take-up core support shaft 10**.

Rockwell hardness values of some sample resin materials are listed as follows:

PS (polystyrene): 130-, POM (polyoxymethylene): 78–120, elastomer: 35–80, ABS (acrylonitrilebutadiene-styrene): 1–10, HDPE (high density polyethylene): 85–100, PP (polypropylene): 90–120.

Accordingly, in forming the take-up core 4 and the take-up core support shaft 10, through selection of appropriate materials and their hardness grades, it is possible to cause the take-up core 4 to be worn more quickly than the take-up core support shaft 10.

The following Table 1 shows some sample combinations of the materials and hardness grades of the take-up core 4 and the take-up core support shaft 10.

Incidentally, when the take-up core 4 and the take-up core support shaft 10 have the same hardness, the configurative means described hereinbefore will be used.

Table 1

| sample combination | take-up core 4 | | take-up core support shaft 10 | |
|---|---|---|---|---|
| No. | material | hardness | material | hardness |
| 1 | POM | 78–120 | POM | 120 |
| 2 | PP | 90–120 | POM | 120 |
| 3 | HDPE | 85–100 | POM | 120 |
| 4 | elastomer | 35–80 | POM | 120 |
| 5 | POM | 78–120 | PS | 130 or more |
| 6 | elastomer | 35–80 | PS | 130 or more |
| 7 | ABS | 110–130 | PS | 130 or more |
| 8 | HDPE | 85–100 | PS | 130 or more |

Table 1-continued

| sample combination | take-up core 4 | | take-up core support shaft 10 | |
|---|---|---|---|---|
| No. | material | hardness | material | hardness |
| 9 | PP | 90–120 | PS | 130 or more |
| 10 | POM | 78–110 | ABS | 110 or more |
| 11 | elastomer | 35–80 | ABS | 110 or more |
| 12 | HDPE | 85–100 | ABS | 110 or more |
| 13 | PP | 90–110 | ABS | 110 or more |

Or, the configurative means and the material-selective means may be used together in combination.

Next, some other embodiments of the present invention will be described.

Figure 7:
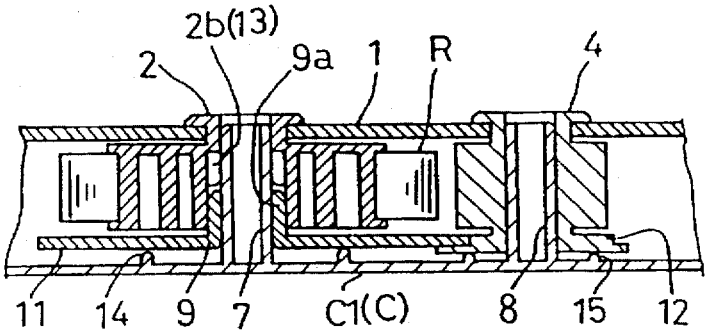
FIG. 7 is a section view showing major portions of a film transfer apparatus relating to a further embodiment of the present invention.

(1) In the foregoing embodiment, the apparatus casing C includes the rotatable feed-core support shaft 9 for dismountably mounting the feed core 2 from the ribbon width direction and the rotatable take-up core support shaft 10 for dismountably mounting the take-up core 4 from the ribbon width direction. Instead, as shown in FIG. 7, the apparatus casing C may include only the rotatable feed-core support shaft 9 for dismountably mounting the feed core 2 from the ribbon width direction.

More particularly, the feed-core tubular fixed shaft 7 provided to the apparatus casing C mounts the feed-core support shaft 9 and the take-up core tubular support fixed shaft 8 mounts the take-up core 4. Further, the feed-core support shaft 9 and the take-up core 4 respectively and integrally form the large and small gear 11, 12 for coupling the feed core 2 with the take-up core 4 so that the take-up core 4 provides a ribbon take-up speed higher than a ribbon feeding speed provided by the feed core 2 even when the diameter of convolution of the film transfer ribbon R on the feed core 2 becomes smaller.

Further, at engaging portions of the feed-core support shaft 9 and the feed core 2, there is provided the slip coupling mechanism 13 for slippably coupling rotation of the take-up core 4 with rotation of the feed core 2.

The engaged portions **2*b* formed in the engaging inner peripheral face of the feed core 2 for engagement with the engaging portion 9*a* formed in the engaging outer peripheral face of the feed-core support shaft 9 are rendered elastically deformable to non-transmitting positions when a rotational force exceeding a predetermined value is applied thereto. Thus, the engaged portions 2*b* of the feed core 2 constitute the slip coupling mechanism 13. Also, the engaged portions 2*b* of the feed core 2 are provided with a mechanical strength smaller than that of the corresponding engaging portion 9*a* of the feed core support shaft 9**.

Figure 8:
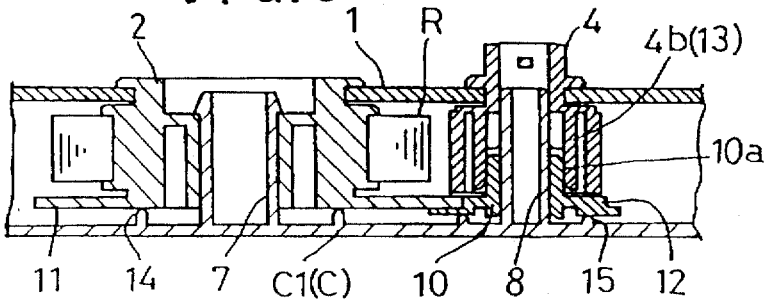
FIG. 8 is a section view showing major portions of a film transfer apparatus relating to a still further embodiment of the present invention.

(2) In the foregoing embodiment, the apparatus casing C includes the rotatable feed-core support shaft 9 for dismountably mounting the feed core 2 from the ribbon width direction and the rotatable take-up core support shaft 10 for dismountably mounting the take-up core 4 from the ribbon width direction. Instead, as shown in FIG. 8, the apparatus casing C may include only the rotatable take-up core support shaft 10 for dismountably mounting the take-up core 4 from the ribbon width direction.

More particularly, the feed-core tubular fixed shaft 7 provided to the apparatus casing C mounts the feed core 2 and the take-up core tubular support fixed shaft 8 mounts the take-up core support shaft 10. Further, the feed core 2 and the take-up core support shaft 10 respectively and integrally form the large and small gear 11, 12 for coupling the feed core 2 with the take-up core 4 so that the take-up core 4 provides a ribbon take-up speed higher than a ribbon feeding speed provided by the feed core 2 even when the diameter of convolution of the film transfer ribbon R on the feed core 2 becomes smaller.

Further, at engaging portions of the take-up core support shaft 10 and the take-up core 4, there is provided the slip coupling mechanism 13 for slippably coupling rotation of the take-up core 4 with rotation of the feed core 2.

The engaged portions **4*b* formed in the engaging inner peripheral face of the take-up core 4 for engagement with the engaging portion 10*a* formed in the engaging outer peripheral face of the take-up core support shaft 10 are rendered elastically deformable to non-transmitting positions when a rotational force exceeding a predetermined value is applied thereto. Thus, the engaged portions 4*b* of the take-up core 4 constitute the slip coupling mechanism 13. Also, the engaged portions 4*b* of the take-up core 4 are provided with a mechanical strength smaller than that of the corresponding engaging portion 10*a* of the take-up core support shaft 10**.

(3) In the foregoing embodiment, when a rotational force exceeding a predetermined level is applied between the take-up core support shaft 10 and the take-up core 4, each engaged portion **4*b* is elastically deformed in the radially outward direction until it comes to the non-transmitting position, i.e. the position past the ridge of the engaging portion 10*a* of the take-up core support shaft 10. Alternately, each engaged portion 4*b* may be elastically deformed in the rotational direction to the non-transmitting position, i.e. to the position past the ridge of the engaging portion 10*a* of the take-up core support shaft 10**.

(4) The base (b) may be any resin film such as of polyimide, polyester, polyethylene, polypropylene or any paper film such as of condenser paper, glassine paper.

(5) A still further embodiment will be described next.

Figure 9:
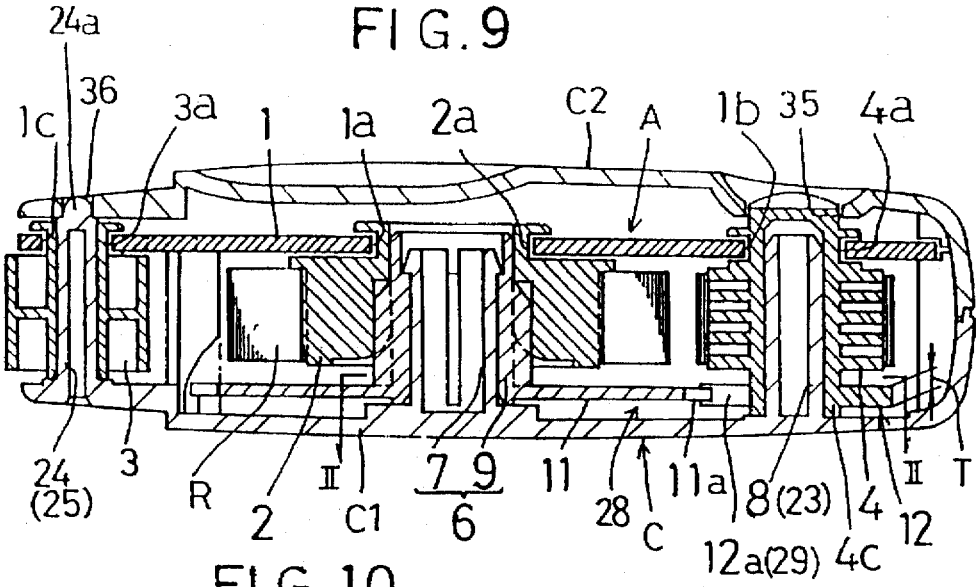
FIG. 9 is a horizontal section view of a film transfer apparatus relating to a still further embodiment of the invention.
Figure 10:
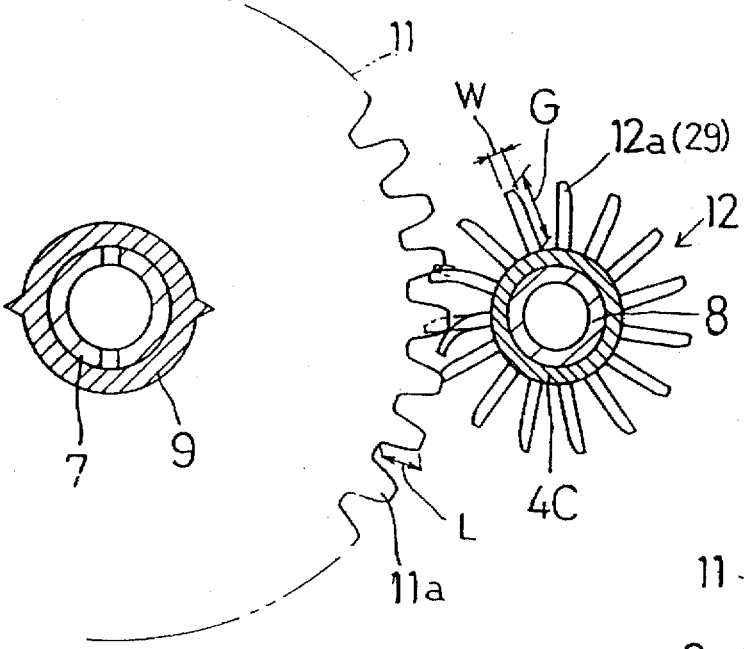
FIG. 10 is a partial enlarged view showing major portions of the apparatus shown in FIG. 9.
Figure 11:
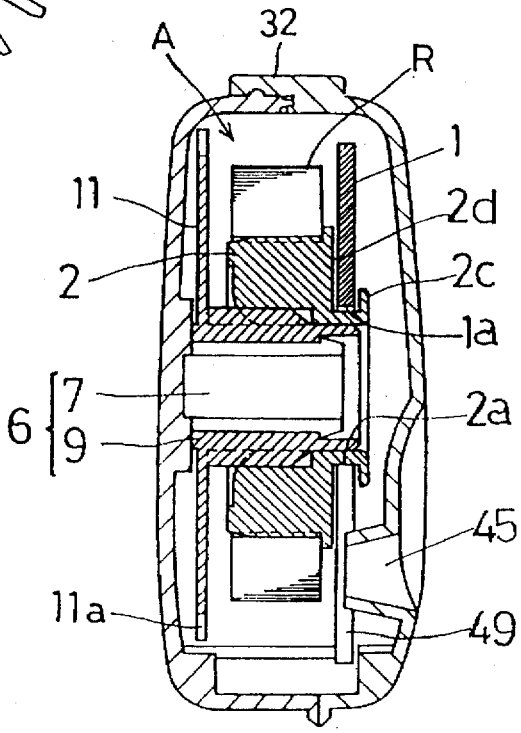
FIG. 11 is a vertical section view of the transfer apparatus shown in FIG. 9.
Figure 12:
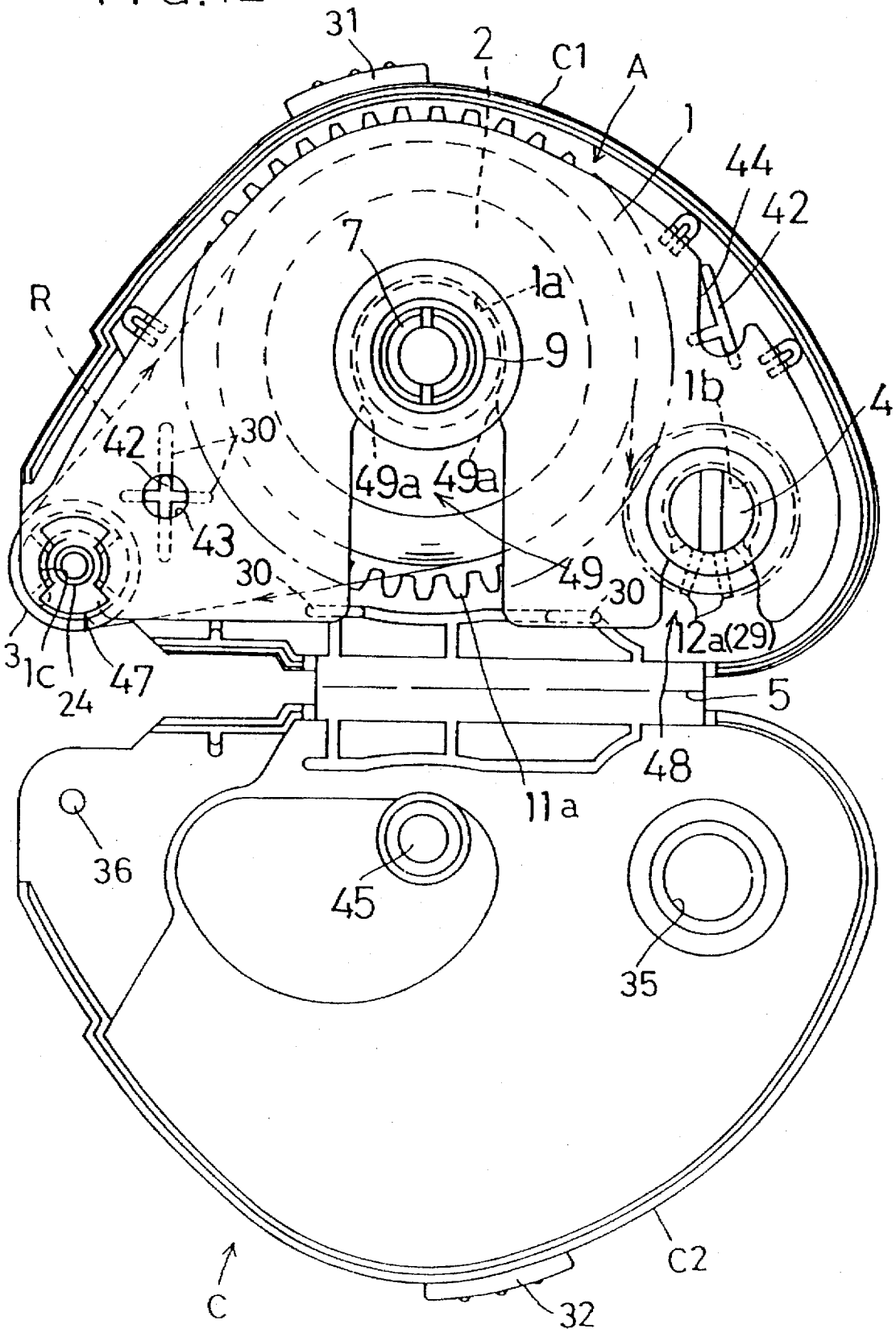
FIG. 12 is a view illustrating a condition of the apparatus of FIG. 9 in which an apparatus casing thereof is opened.
Figure 13:
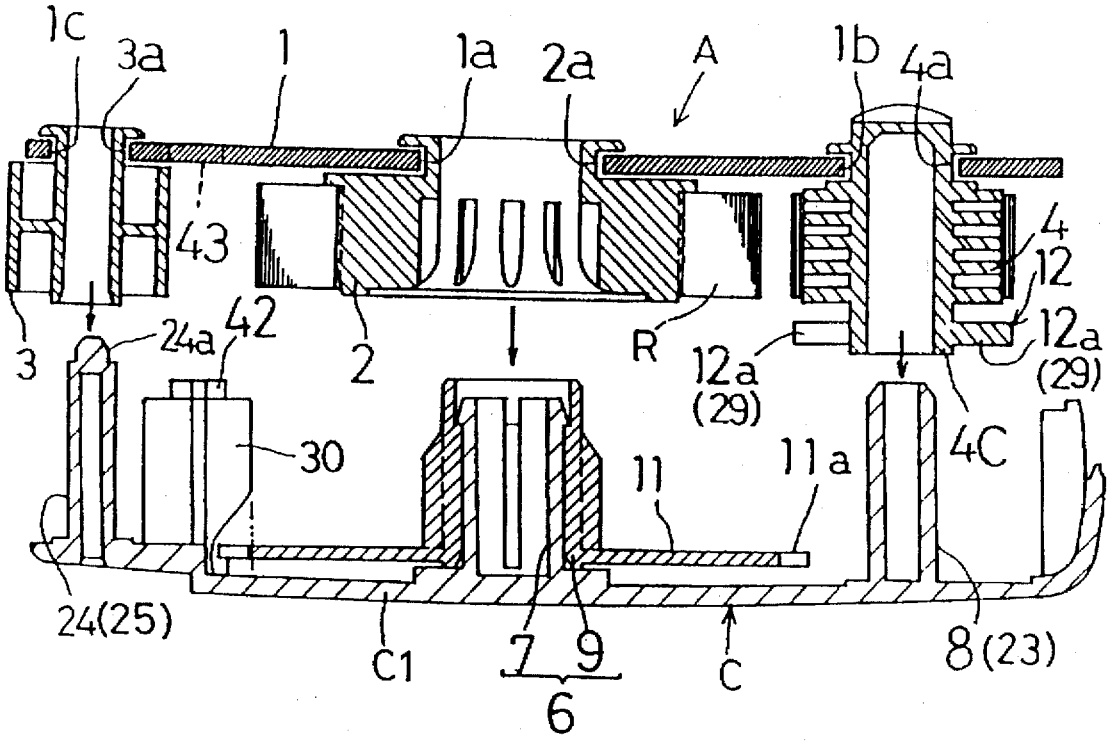
FIG. 13 is a horizontal section view illustrating a further condition of the apparatus of FIG. 9 in which the apparatus casing and a ribbon cassette are detached from each other.
Figure 14:
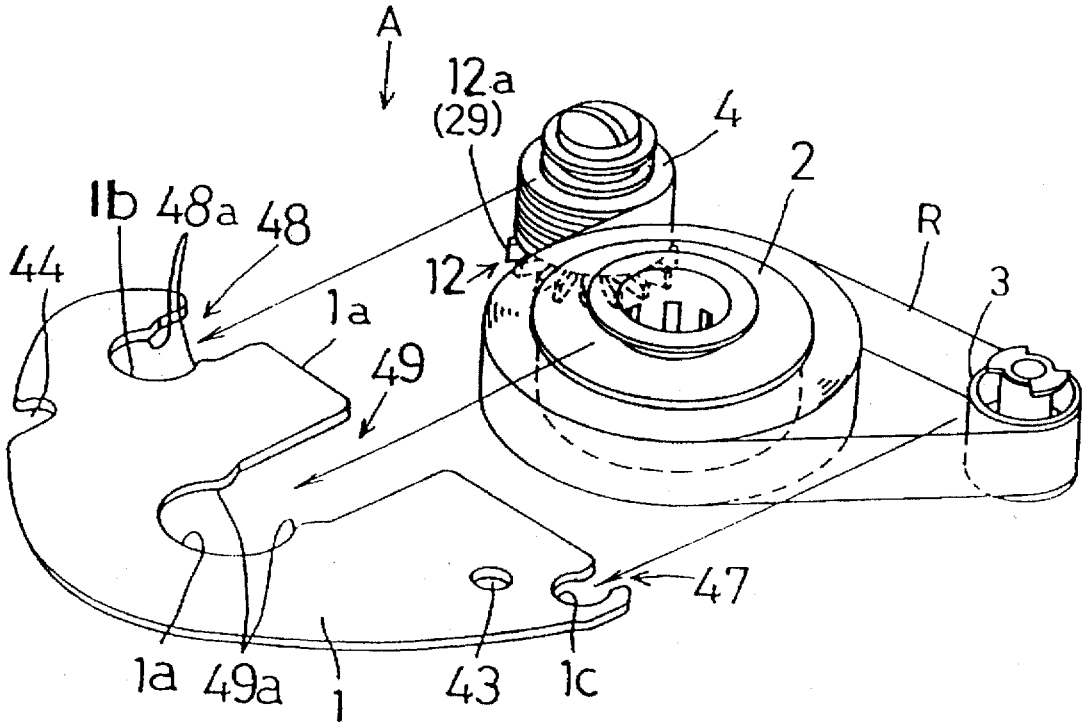
FIG. 14 is an exploded perspective view showing a film transfer apparatus relating to a still further embodiment of the present invention.
Figure 15:
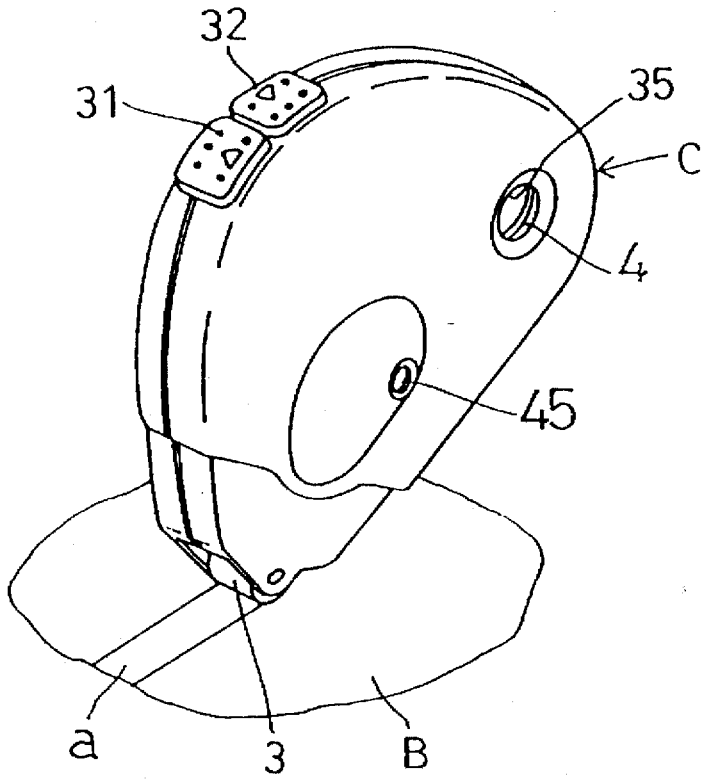
FIG. 15 is a perspective view illustrating an in-use condition of the apparatus shown in FIG. 9.

FIGS. 9 and 11 show a film transfer apparatus relating to this embodiment having a film transfer ribbon cassette A detachably attached within an apparatus casing C. In the ribbon cassette A, as shown in FIGS. 12 through 14, a film transfer ribbon R having a transfer film such as an adhesive transfer film (a) on one side thereof is entrained, with the adhesive transfer film (a) oriented to the outside, between a feed core 2 made of resin and a take-up core 4 made of resin via a transfer roller 3 made of resin as an example of a transfer head. And, these cores 2, 4 and the transfer roller 3 are supported on a plate-like support member 1 made of paper or resin.

The support member 1, as best shown in FIG. 14, has an outer configuration substantially corresponding to the inner periphery of the apparatus casing C into which the member 1 is to be attached. Further, the support member 1 includes a feed-core attaching hole **1*a*, a take-up core attaching hole 1*b* and a transfer-roller attaching hole 1*c* for rotatably attaching respectively the cores 2, 4 and the transfer roller 3 at one end thereof through engagement with peripheral grooves 2*a*, 4*a*, 3*a* formed in one end of the cores 2, 4 and the roller 3 in the ribbon width direction. A reference mark 2*c* denotes a flange provided at one end portion 2*d* of the feed core 2**.

Further, through the outer peripheral edge and the respective attaching holes **1*a*, 1*b*, 1*c* of the support member 1, there are formed, as cutouts, a feed-core guide passage 49, a take-up core guide passage 48 and a transfer-roller guide passage 47 extending substantially parallel to each other for allowing attachment and detachment of the peripheral grooves 2*a*, 4*a*, 3*a* of the cores 2, 4 and roller 3 from the outer peripheral edge of the support member 1, so that the attaching holes 1*a*, 1*b*, 1*c* are opened along a same direction relative to the outer peripheral edge of the support member 1**.

The width of the feed-core guide passage 49 is rendered substantially same as a diameter of the feed-core attaching hole 1*a*. At a portion of the support member 1 corresponding to the border between the guide passage 49 and the attaching hole 1*a*, there are integrally formed opposed projections 49*a* projecting into the width of the passage thereby rendering this passage width slightly narrower than an inner diameter of the peripheral groove 2*a* of the feed core 2.

Like the feed-core guide passage 49, the width of the take-up core guide passage 48 is rendered substantially same as a diameter of the take-up core attaching hole 1*b*. At a portion of the support member 1 corresponding to the border between the guide passage 48 and the attaching hole 1*b*, there are integrally formed opposed projections 48*a* projecting into the width of the passage thereby rendering this passage width slightly narrower than an inner diameter of the peripheral groove 4*a* of the take-up core 4.

Then, after inserting the peripheral grooves 2*a*, 4*a* of the feed core 2 and the take-up core 4 into the feed-core guide passage 49 and the take-up core guide passage 48 respectively, these cores 2, 4 are forced into the attaching holes 1*a*, 1*b* by a pressing force exceeding a certain magnitude, the narrower passage width between the opposed projections 49*a* is elastically extended through pressed contact with the inner peripheral face of the peripheral groove 2*a* of the feed core 2 and also the narrower passage width between the opposed projections 48*a* is elastically extended through pressed contact with the inner peripheral face of the peripheral groove 4*a* of the take-up core 4, whereby the respective cores 2, 4 are rotatably supported to the support member 1 at one end thereof.

With realization of the above condition where the cores 2, 4 are rotatably supported to the support member 1, the respective projections 48*a*, 49*a* are elastically returned to their original positions, thereby preventing withdrawal of the cores 2, 4 from the support member 1 unless a force exceeding a predetermined magnitude is applied to the cores in the withdrawing direction.

The transfer-roller guide passage 47 has a passage width which is slightly smaller than the diameter of the transfer-roller attaching hole 1*c*.

Then, when the peripheral groove 3*a* of the transfer roller 3 is forced into this guide passage 47 by a force exceeding a predetermined magnitude toward the transfer-roller attaching hole 1*b*, the passage width of the guide passage 47 is elastically extended through pressed contact with the inner peripheral face of the peripheral groove 3*a* of the transfer roller 3, so that the transfer roller 3 may be rotatably supported to the support member 1 through one end thereof.

With realization of the above condition where the transfer roller 3 is rotatably supported to the support member 1, the passage width of the transfer-roller guide passage 47 is elastically returned to the original state, thereby preventing withdrawal of the transfer roller 3 from the support member 1 unless a force exceeding a predetermined magnitude is applied to the roller in the withdrawing direction.

The support member 1 further includes a through hole 43 and a cutout groove 44 for respective engagement with two projections 42 of the apparatus casing C thereby fixedly positioning the support member 1 relative to the apparatus casing C. When the support member 1 is attached within the apparatus casing C, a window hole 45 formed in the apparatus casing C allows visual confirmation therethrough of an amount of remaining un-used film transfer ribbon R coiled around the feed core 2 through the feed-core guide passage 49.

FIGS. 9 through 13 illustrate the above condition where the ribbon cassette A is attached in the apparatus casing C. The apparatus casing C includes a case body portion C1 and a case lid portion C2 formed integrally with each other. Further, a plate-like conjoining portion joining the case body portion C1 and the case lid portion C2 is formed thin, so that this thin conjoining portion constitutes a hinge portion 8 for allowing the case members C1, C2 to be pivotably opened and closed relative to each other.

The case body portion C1 includes a feed-core support portion 8 having a feed-core support shaft 9 made of resin for co-rotatably mounting thereon the feed core 2 and a feed-core fixed shaft 7 for rotatably supporting the feed-core support shaft 9, a take-up core support portion 23 comprising a take-up core fixed shaft 8 for rotatably mounting the take-up core 4 and also a head support portion 28 comprising a transfer-head support shaft 24 for rotatably mounting the transfer roller 3.

The feed-core support shaft 9 integrally forms a large first gear 11 as one of a pair of transmission means and the take-up core 4 integrally forms a small second gear 12 as the other of the pair of transmission means, so that the first gear 11 is rotatable about the axis of the feed core 2 and the second gear 12 is rotatable about the axis of the take-up core 4.

The second gear 12 is comprised of a plurality of teeth 12*a* radially equidistantly provided through the entire outer peripheral face of a cylindrical element 4B integrally projecting from one end of the take-up core 4 opposite to the side forming the peripheral groove 4*a* relative to the ribbon width direction. Further, a tooth height G of the teeth 12*a* of the second gear 12 is designed to be about twice as long as a tooth height L of teeth 11*a* of the first gear 11. In addition, a rotational tooth width W of the teeth 12*a* of the second gear 12 is designed to be smaller than a tooth thickness T of the teeth 12*a*.

In operation, as the rotation of the feed core 2 and the rotation of the take-up core 4 are coupled with each other through meshing between the two gears 11, 12, the feed core 2 is rotated to feed the film transfer ribbon R while the used ribbon R is wound about the take-up core 4. This entire construction constitutes a gear coupling mechanism 28.

With this gear coupling mechanism 28, the gear ratio between the two gears 11, 12 is adapted so that the ribbon take-up speed of the take-up core 4 is faster than the ribbon feeding speed of the feed core 2 even when the diameter of the ribbon R wound about the feed core 2 becomes smaller. Hence, the used ribbon R may be taken up reliably. Further, an excessive tension resulting from the difference between the ribbon feeding speed and the ribbon take-up speed may be absorbed by slippage occurring between the teeth 11*a* of the first gear 11 of the feed core and the teeth 12*a* of the second gear 12 of the take-up core 4. In other words, when a relative rotational force beyond a predetermined magnitude affects the teeth 11*a* of the first gear 11 and the teeth 12*a* of the second gear 12 due to such excessive tension of the ribbon R, the elastic deformable teeth 12*a* of the second gear 12 are elastically collapsed to a non-transmitting state by being pressed from the teeth 11*a* of the first gear 11, i.e. to a position downstream in the rotational direction of this small gear 12, so that the meshing between the teeth 11*a*, 12*a* is released to break force transmission between the two gears 11, 12. With this, the difference between the ribbon feeding speed and the ribbon take-up speed may be absorbed. Hence, the teeth 12*a* of the second gear 12 constitutes a slip coupling mechanism 29.

Incidentally, the feed-core support shaft 9 and the first gear 11 formed integrally therewith are formed specifically of a resin material having a relatively high hardness at the normal temperature, such as ABS resin, POM (polyacetal) resin, polypropylene, polystyrene and so on. On the other hand, the take-up core 4 and the second gear 12 formed integrally with this take-up core 4 are formed of a resin material having a lower hardness at the normal temperature than the first gear 11 and capable of elastic deformation at the normal temperature such as low-density polyethylene, elastomer and so on.

As shown in FIGS. 9 and 13, the case body portion C1 integrally forms a contact element 30 for contact with the support member 1 of the film transfer cassette A when attached within the apparatus casing C so as to prevent this support member 1 from being flexed toward the case body portion C1.

As shown in FIG. 12, on the outer peripheral faces of the respective case portions C1, C2, there are provided lock members 31, 32 for contacting the outer peripheral face of the other case portion C2 or C1 thereby locking the case portions C1, C2 at the closed condition. By moving these lock members 31, 32 in an opening direction, the case portions C1, C2 are released from the locked condition to be opened relative to each other. Accordingly, the unlocking operation of the lock members 31, 32 and the opening operation of the apparatus casing C may be conveniently effected by the one-step operation.

Next, an attaching operation of the film transfer ribbon cassette A will be described.

As shown in FIGS. 9 and 12, the apparatus casing C is opened, and the projections 42 formed on the case body portion C1 are fitted respectively into the through hole 43 and the cutout groove 44 of the support member 1, thus fixedly positioning the ribbon cassette A to the case body portion C1. Also, the cores 2, 4 are mounted, from their free ends, onto the respective shafts 8, 9 of the support portions 6, 23 and at the same time the transfer roller 3 is fitted on the support shaft 24 of the head support portion 25. With this, the film transfer ribbon cassette A is attached to the case body portion C1 and the teeth 11*a* of the first gear 11 and the teeth 12*a* of the second gear 12 are meshed with each other.

Under the above condition, as the case lid portion C2 is closed, the leading end of the rotary shaft 4B of the take-up core 4 becomes exposed outside the apparatus casing C through the through hole 35 formed in the case lid portion C2, and also a projection 24*a* of the leading end of the support shaft 24 is inserted into the through hole 36 formed in the case lid portion C2, so that the support shaft 24 is supported through its opposed ends to and between the two case portions C1, C2.

When the entire film transfer ribbon R housed in the apparatus casing C has been used, the lock members 31, 32 of the casing C are opened to allow the case lid portion C2 to be pivotably opened relative to the case body portion C1. Then, the ribbon cassette A together with the support member 1 is removed from the case body portion C1 and is replaced by a new ribbon cassette A including an un-used film transfer ribbon R wound about its feed core 2.

(6) A still further embodiment of the invention will be described next.

Figure 16:
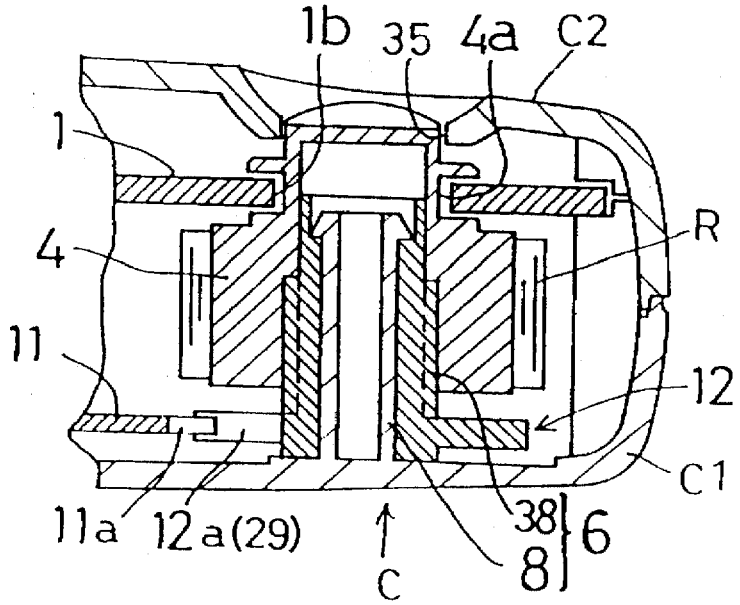
FIG. 16 is a horizontal section view showing a film transfer apparatus relating to a still further embodiment of the invention.

As shown in FIG. 16, in this embodiment, the second gear 12 and the take-up core 4 are provided as two separate elements. And, a tubular shaft 38 having the second gear 12 is rotatably and unwithdrawably mounted on the take-up core fixed shaft 8, and the take-up core 4 is rotatably mounted on this tubular shaft 38.

In this case, when the ribbon cassette A is removed from the apparatus casing C, the second gear 12 is retained by the case body portion C1 with the meshing condition thereof with the first gear 11 being maintained. The take-up core fixed shaft 8 and the tubular shaft 38 of the second gear 12 together constitute the take-up core support portion 6.

The remaining portions of the construction of this embodiment are the same as those of the foregoing embodiment.

Figure 17:
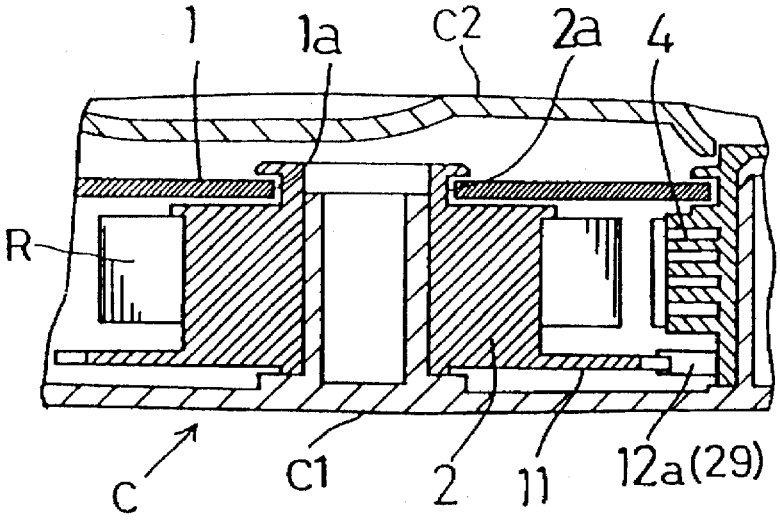
FIG. 17 is an enlarged view showing major portions of a film transfer apparatus relating to a still further embodiment of the invention.

(7) Further, as illustrated in FIG. 17, the feed core 2 and the first gear 11 may be formed integrally with each other. In this case, the coupling construction between the feed core 2 and the take-up core 4 including the slip mechanism 29 may be formed of two components. Then, with this reduction in the number of components required, the assembly operation may be further facilitated.

The other portions of the constructions are the same as those of the foregoing embodiment.

Figure 18:
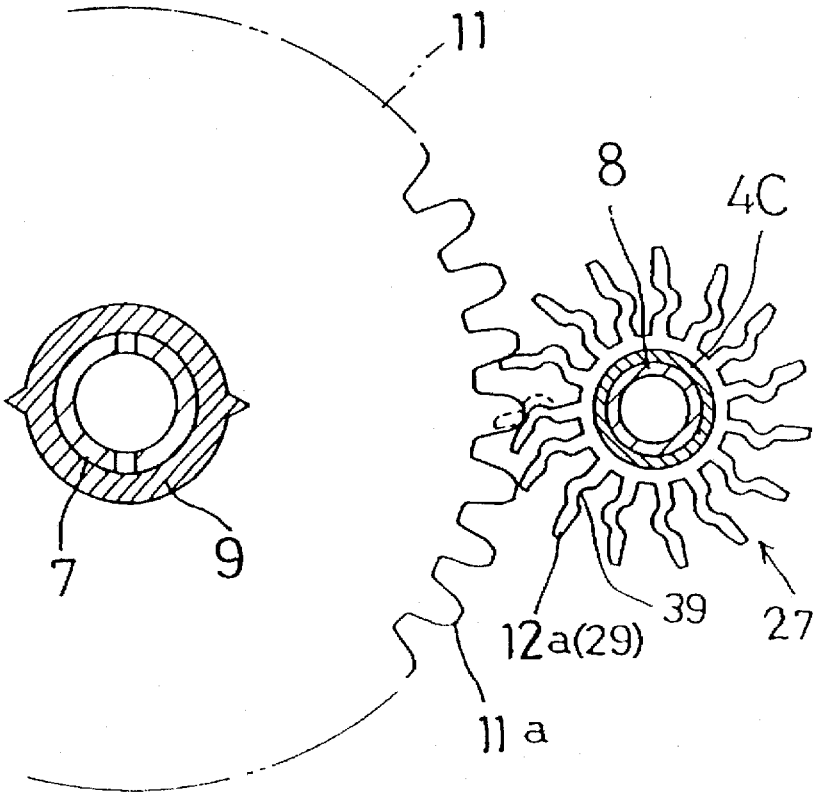
FIG. 18 is an enlarged view showing major portions of a film transfer apparatus relating to a still further embodiment of the invention.

(8) Still further, as shown in FIG. 18, at a height-wise intermediate portion of the tooth 12*a* of the second gear 12, a curved portion 39 projecting in the 'U' shape to the upstream side of the rotational direction of this second gear 12 may be formed, so that this curved tooth 12*a* constitutes the slip coupling mechanism 29.

In this case, the elastic deformation of the tooth 12*a* may be promoted by the presence of the curved portion 39.

Figure 19:
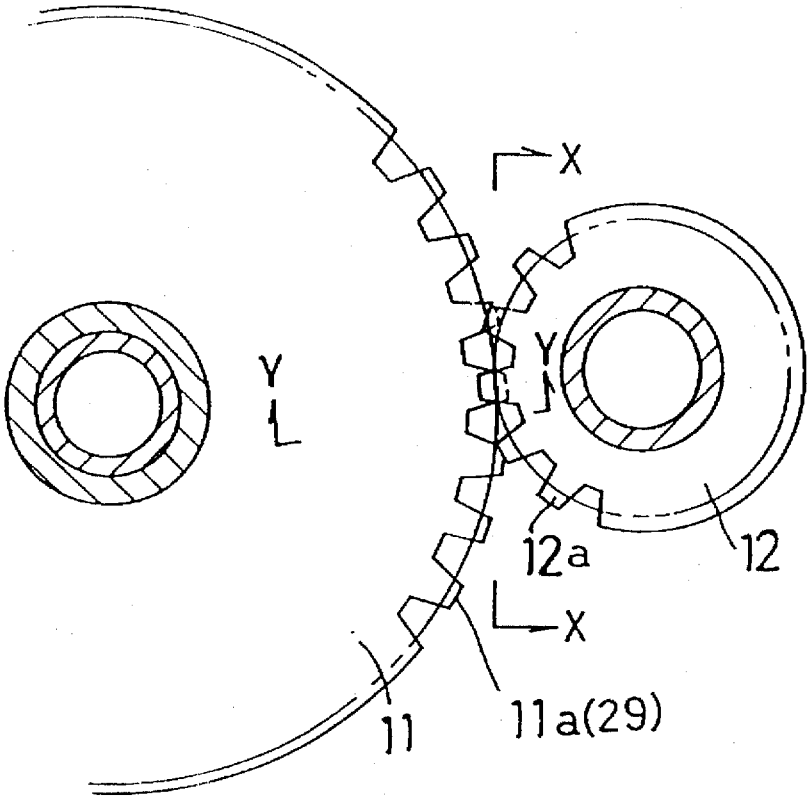
FIG. 19 is an enlarged view showing major portions of a film transfer apparatus relating to a still further embodiment of the invention, FIG. 20(*a*) is a section view taken along a line X—X of FIG. 19, FIG. 20(*b*) is a section view taken along a line Y—Y of FIG. 19, FIG. 21(*a*) is a section view illustrating a slip condition of the construction shown in FIG. 20(*a*), FIG. 21(*b*) is a section view illustrating a slip condition of the construction shown in FIG. 20(*b*)
Figure 20:
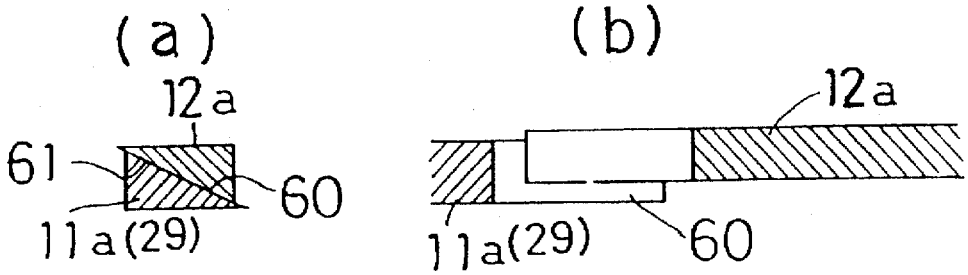
Figure 21:
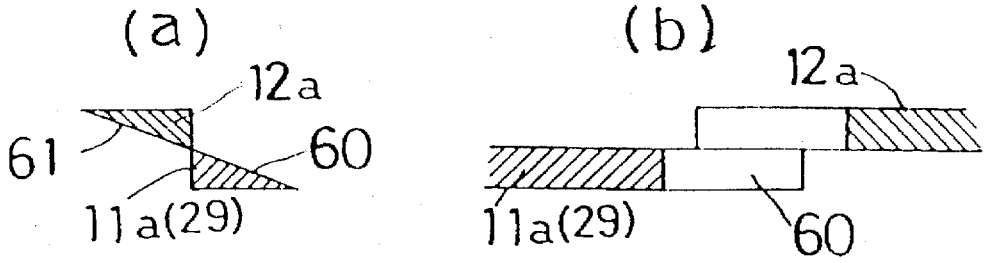

(9) Further, as shown in FIGS. 19 through 21, at the engaging portions of the tooth 11*a* of the first gear 11 and the tooth 12*a* of the second gear 12, inclined cam faces 60, 61 may be formed for allowing the elastic deformation of the tooth 11*a* of the first gear 11 to a non-meshing position on one side in the direction of the rotational axis with application of an excessive relative rotational force between the gears 11, 12, such that these teeth 11*a*, 12*a* may pass one above the other in the direction of the rotational axis.

Further alternately, both the tooth 11*a* of the first gear 11 and the tooth 12*a* of the second gear 12 may be adapted to be elastically deformed to the respective non-meshing positions on the opposite sides in the direction of the rotational axis, with the application of the excessive relative rotational force to the two gears 11, 12.

(10) In the foregoing embodiments described hereinbefore, the slip coupling mechanism 29 is comprised of the tooth 12*a* of the second gear 12 of the take-up core 4 which tooth is rendered elastically deformable to the non-meshing state with application of excessive relative rotational force. Instead, the slip coupling mechanism 29 may be comprised of the tooth 11*a* of the first gear 11 of the feed core 2 which tooth is rendered elastically deformable to the non-meshing state with application of excessive relative rotational force. Further, both of these teeth 11*a*, 12*a* may be rendered elastically deformable to the respective non-meshing states with application of the excessive force, such that these teeth 11*a*, 12*a* together constitute the slip coupling mechanism 29.

(11) The materials forming the first gear 11 and the second gear 12 are not particularly limited in the present invention. For instance, the second gear 12 may be formed of the POM resin while the first gear 11 may be formed of the ABS resin, POM resin, polypropylene or polystyrene.

Incidentally, when the first gear 11 and the second gear 12 are formed of a same material, these gears 11, 12 may be distinguished from each other in the hardness or one of the gears may be provided with a configuration more tending to deform than the other.

In short, as long as the tooth of at least one of the two gears 11, 12 is rendered to be elastically deformed to a non-meshing state with application of an excessive relative rotational force, the kinds of the materials and shapes of these gears may be conveniently varied.

(12) In the foregoing embodiment, for allowing insertion and loose fitting of one end, in the ribbon width direction, of each of the feed core 2, take-up core 4 and of the transfer roller 3 relative to the feed-core attaching hole 1*a*, take-up core attaching hole 1*b* and the transfer roller attaching hole 1*c* of the support member 1, the guide passages 47, 48, 49 are formed as cutouts extending between the respective attaching holes 1*a*, 1*b*, 1*c* and the outer peripheral edge of the support member 1. Instead, with eliminating these guide passages 47, 48, 49, the respective peripheral grooves 2*a*, 4*a*, 3*a* of the cores 2, 4 and the transfer roller 3 may be loosely fitted within the attaching holes 1*a*, 1*b*, 1*c*.

(13) In the foregoing embodiments, in the ribbon cassette A, the feed core 2, the take-up core 4 and the transfer roller 3 are supported at respective one end thereof to the support member 1, so that the transfer ribbon R may be replaced by replacement of this ribbon cassette A relative to the apparatus casing C. Instead, without using such ribbon cassette A, the feed core 2, the take-up core 4 and the transfer roller 3 may be attached respectively to the feed-core support portion 6, the take-up core support portion 23 and the head support portion 25.

(14) The transfer head 3 may be a non-rotatable stationary type, instead of the roller type described above.

(15) In the foregoing embodiments, when an excessive relative rotational force is applied to the first and second gears 11, 12, the tooth constituting the slip coupling mechanism 29 is elastically deformed to the downstream side in the rotational direction or in the direction of the rotational axis. Instead, this tooth constituting the slip coupling mechanism 29 may be adapted to be elastically deformed in the radially inward direction.

(16) A still further embodiment of the invention will be described next.

FIGS. 22 through 25 illustrate opening and closing conditions of an apparatus casing C. This apparatus casing C includes a case body portion C1 having a peripheral wall 26, a case lid portion C2 having a peripheral wall 27, and a hinge portion 5 for pivotably joining these case portions C1, C2 to be opened and closed relative to each other in the ribbon width direction. And, the case portions C1, C2 and the hinge portion 5 are formed integrally with each other by an injection molding of polypropylene. Further, a pivotal axis portion 5*a* of the hinge portion 5 is formed thin for enhancing the flexibility of the hinge portion 5.

The peripheral walls 26, 27 together form an opening for allowing projection of the transfer roller 3 to the outside of the apparatus casing C.

Further, the outer peripheral face of the peripheral wall 26 of the case body portion C1 integrally forms an engaging portion 31 as a locking member for engagement with the projection 22 formed integrally on the outer peripheral face of the peripheral wall 27 of the case lid portion C2 thereby locking these two case portions C1, C2 at the mutually closed condition (i.e. the closed condition of the apparatus casing C). The projection 22 and the engaging portion 31 together constitute a lock portion E.

The outer peripheral face of the peripheral wall 27 of the case lid portion C2 integrally forms an operational portion 32 disposed adjacent the engaging portion 31 in the peripheral direction of the peripheral walls 28, 27 when the case portions C1 and C2 are closed to each other.

From the above-described closed condition of the case portions C1, C2, if the engaging portion 31 and the operational portion 32 are moved relative to each other in the opening direction of the case portions C1, C2, the engagement between the engaging portion 31 of the case body portion C2 and the projection 22 of the case lid portion C2 is forcibly released, thereby unlocking the case portions C1, C2 from the closed condition.

Accordingly, the unlocking operation of the lock portion E and the opening operation of the apparatus casing C may be conveniently effected by the one-step operation.

Of the case body portion C1 and the case lid portion C2, at three positions in the inner peripheral face of the peripheral wall 26 of the case body portion C1, there are integrally formed U-shaped guide portions 40 having a 'U'-shaped cross section and projecting from the opened end to the outer side in the ribbon width direction. With these guide portions 40, when the peripheral wall 27 of the case lid portion C2 is deformed inwards relative the case lid portion C2 (the condition denoted with a broken line in FIG. 23) due to contraction tending to occur in the course of the integral molding of the apparatus casing C and when the case portions C1 and C2 are closed under this condition, curved outer faces of the guide portions 40 come into sliding contact with the inner peripheral face of this inclined peripheral wall 27, so that the guide portions 40 press the inner peripheral face of the inclined peripheral wall 27 to the outside, thus forcibly correcting and guiding the inclinedly deformed peripheral wall 27 to its proper vertical posture. Consequently, the opening-side ends of the peripheral walls 26, 27 of the two case portions C1, C2 may be guided to their proper conditions opposing to each other.

In the opening ends of the peripheral walls 26, 27 of the case portions C1, C2, at the opening end of the case body portion C1 except for its portion coextending to the hinge portion 5 and centrally of its thickness direction, there is integrally formed a projecting ridge 41, while a projection ridge 62 is integrally formed at the opening end of the case lid portion C2 and at a position displaced inwards relative to the thickness direction.

A concave portion 37 formed between the projecting ridge 41 and the guide portion 40 and a convex portion 33 formed by the projecting ridge 62 come into engagement with each other in the ribbon width direction when the case portions C1, C2 are pivotably closed to each other. The concave portion 37 and the convex portion 33 together constitute an engagement regulating portion F. Then, this engagement regulating portion F restricts relative movement between the two case portions C1, C2 in the direction of thickness of the peripheral walls 26, 27 and re-declining deformation of the peripheral wall 27 of the case lid portion C2 whose posture has been corrected to the vertical posture by the guide portions 40.

Accordingly, with the presence of the guide portions 40, in association with the closing operation of the two case portions C1, C2, the correcting operation of the inclined peripheral wall 27 of the case lid portion C2 to the vertical posture and the engaging operation, from the ribbon width direction, of the engagement regulating portion F the opening ends of the peripheral walls 26, 27 of the case portions C1, C2 may be conveniently effected by the one-step operation.

Further, the case body portion C1 integrally forms, in its inside, two projections 62 engageable respectively with the through hole 43 and the cutout groove 34 of the support member 1 thereby to fixedly position this support member 1 relative to the case body portion C1 in the direction of the plate face. The case lid portion C2 forms a window hole 45 for allowing visual check of a remaining amount of the unused ribbon R wound about the feed core 2 through feed-core guide passage 49 when the support member 1 is attached within the apparatus casing C.

Figure 22:
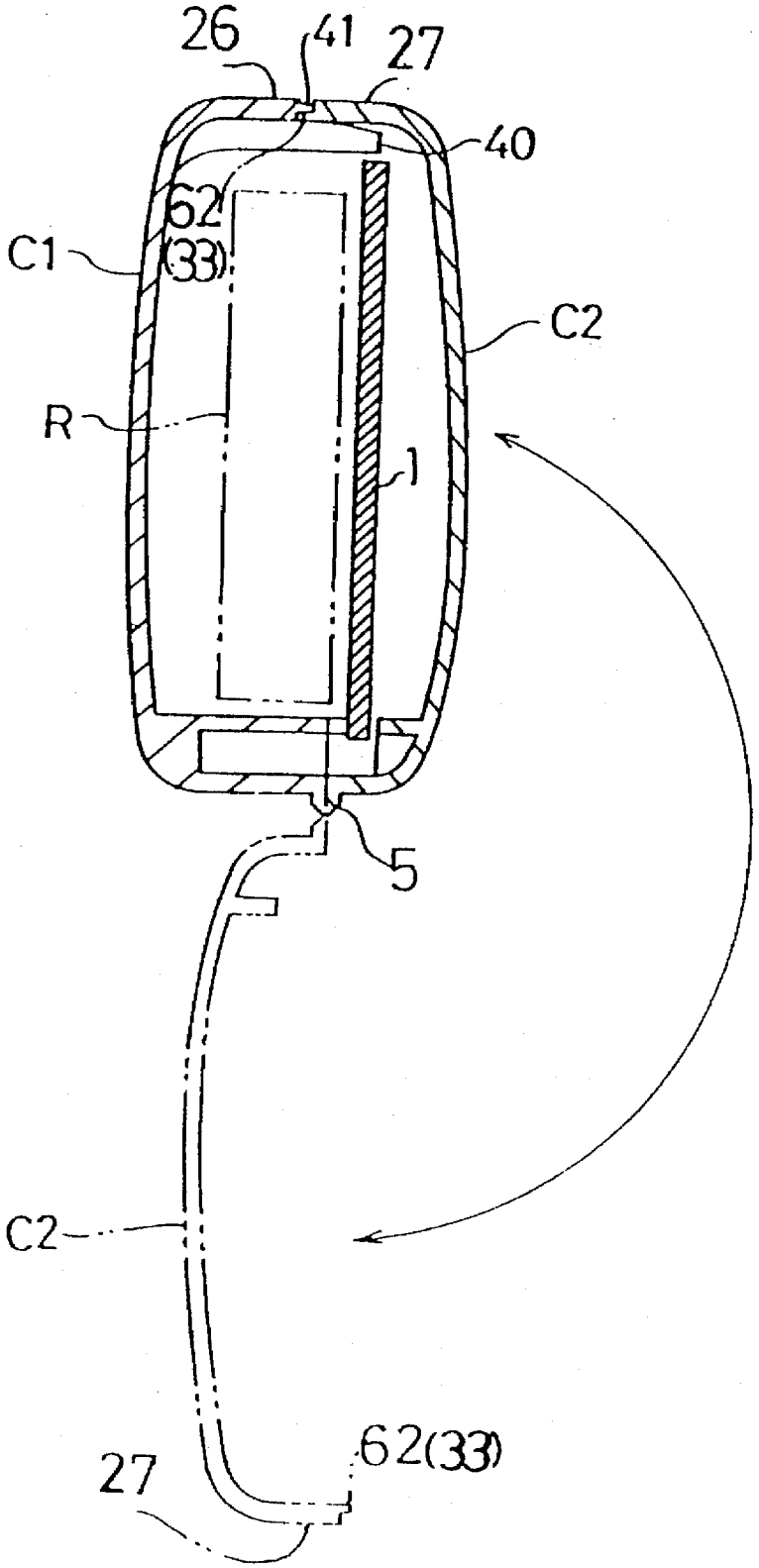
FIG. 22 is a vertical section view showing a film transfer apparatus relating to a sill further embodiment under a condition in which an apparatus casing thereof is opened and closed at a guide portion.
Figure 23:
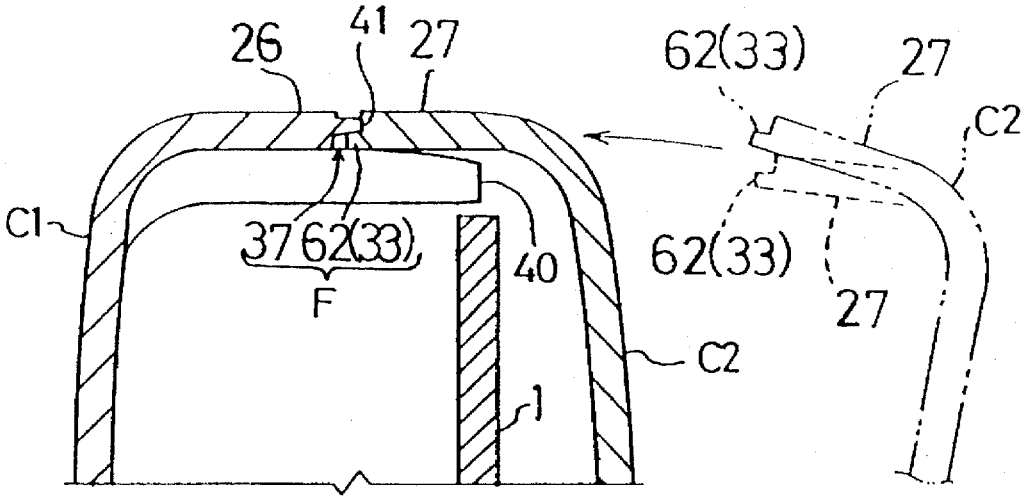
FIG. 23 is an enlarged view showing major portion of the apparatus shown in FIG. 22.
Figure 24:
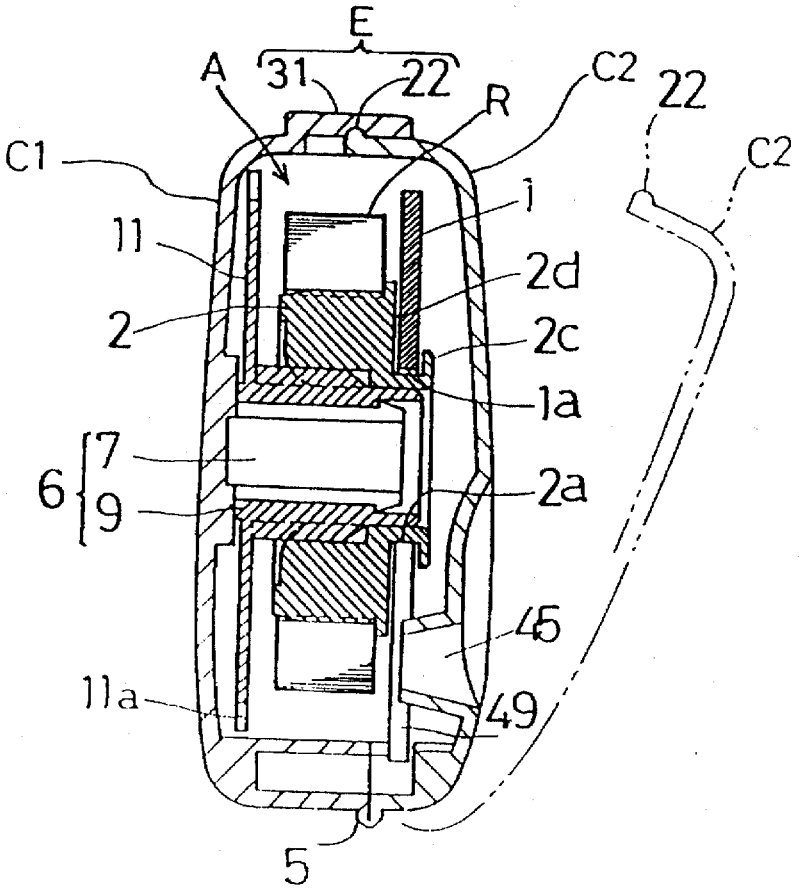
FIG. 24 is a vertical section view showing the film transfer apparatus of FIG. 22 and illustrating a condition in which the apparatus casing is opened and closed at a locking portion.
Figure 25:
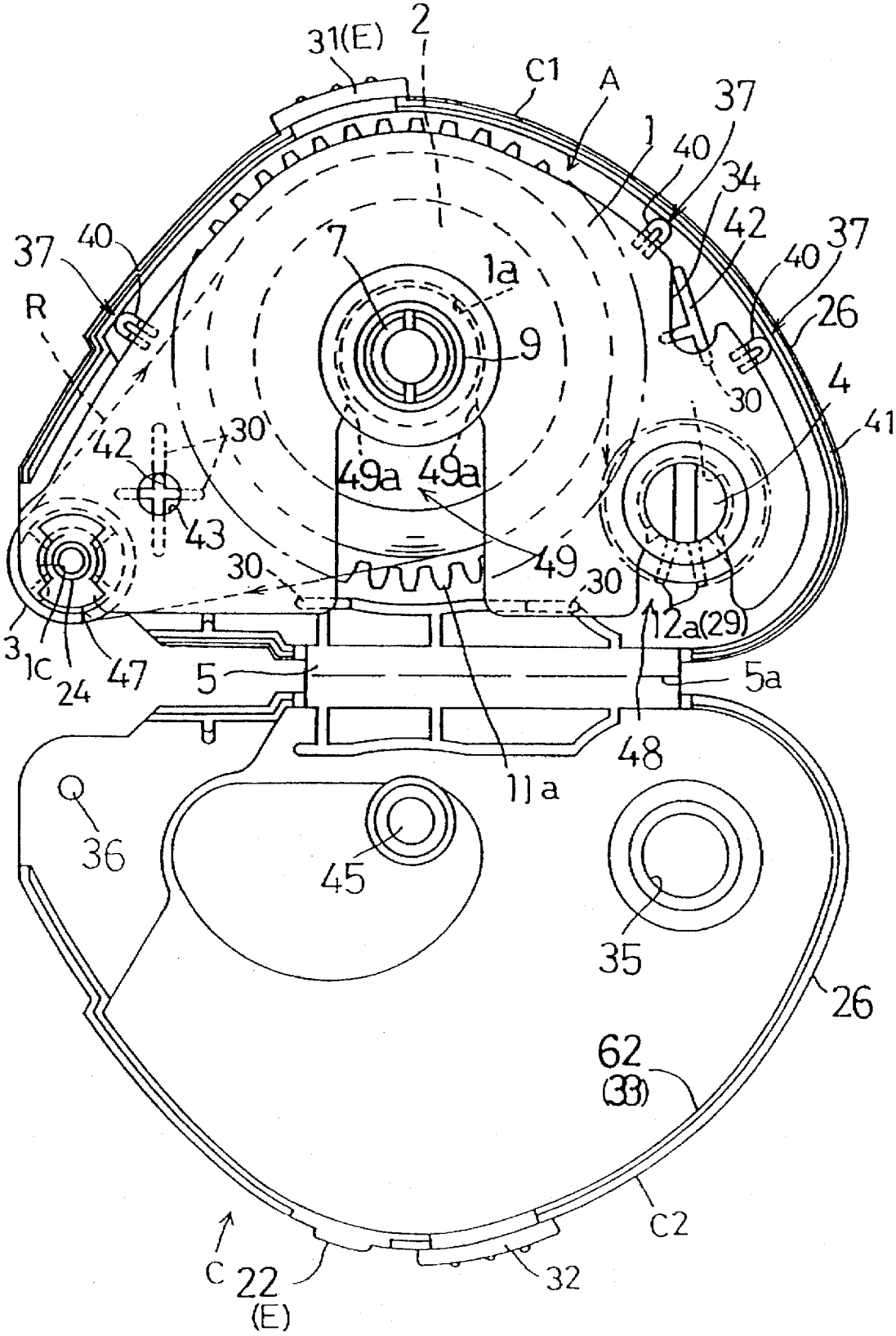
FIG. 25 is a front view illustrating a condition of the apparatus of FIG. 22 in which the apparatus casing is opened.

Next, attaching and detaching operations of the film transfer ribbon cassette A will be described. As shown in FIGS. 22 and 25, the apparatus casing C is opened. Then, the through hole 43 and the cutout groove 34 of the support member 1 are fitted with the projections 62 formed on the case body member C1, thereby to fixedly position the ribbon cassette A to the case body portion C1. Further, the cores 2, 4 are mounted, from their free ends, onto the the support shaft 9 and the fixed shaft 8 of the support portions 6, 23, and at the same time the transfer roller 3 is fitted on the support shaft 24 of the head support portion 25. With this, the film transfer ribbon cassette A is attached to the case body portion C1 and the teeth 11*a* of the first gear 11 and the teeth 12*a* of the second gear 12 are meshed with each other.

Under the above condition, as the case lid portion C2 is closed, the leading end of the rotary shaft 4C of the take-up core 4 becomes exposed outside the apparatus casing C through the through hole 35 formed in the case lid portion C2, and also a projection 24*a* of the leading end of the support shaft 24 is inserted into the through hole 36 formed in the case lid portion C2, so that the support shaft 24 is supported through its opposed ends to and between the two case portions C1, C2.

When the entire film transfer ribbon R housed in the apparatus casing C has been used, the lock portion E is opened to allow the case lid portion C2 to be pivotably opened relative to the case body portion C1. Then, the ribbon cassette A together with the support member 1 is removed from the case body portion C1 and is replaced by a new ribbon cassette A including an un-used film transfer ribbon R wound about its feed core 2.

In the above embodiment, the apparatus casing C is formed of polypropylene. However, the material forming this casing is not limited thereto. And, if the pivotal axis portion 5*a* of the hinge portion 5 can resist repeated flexions, this apparatus casing C may be formed of the ABS resin, polyethylene resin or the like.

(17) In the above embodiment, the engagement regulating portion F is constituted by the concave portion 37 formed at the opened end of the case body portion C1 and the convex portion 33 formed at the opened end of the case lid portion C2. Instead, each opened end may form a concave portion and a convex portion in a continuous manner. In this case, the concave and convex portions of one opened end and the convex and concave portions of the other opened end together constitute the engagement regulating portion F.

(18) The guide portions 40 may be eliminated. Instead, the opened end per se of the peripheral wall 26 of the case body portion C1 will form a concave portion into which the convex portion 33 of the opened end of the case lid portion C2 may engage from the ribbon width direction.

(19) In the present invention, the transfer film D is not limited to the pressure sensitive adhesive film described hereinbefore. Instead, a transfer film for correction or for decoration or coloring may be used. Further, instead of the pressure sensitive type. The film may be a heat sensitive type as well. In these manners, the type, function and usage of the transfer film are not particularly limited in the present invention.

(20) In the foregoing embodiments, the transfer head 3 is the rotatable roller type. Instead, this may be a non-rotatable stationary type. Further, the transfer head 3 may be formed integrally with one of the case portions.

(21) In the foregoing embodiments, the feed core 2 and the take-up core 4 are coupled with each other via the gear coupling mechanism 28. Instead, the feed core 2 and the take-up core 4 may be coupled via a belt coupling mechanism.

(22) A still further embodiment of the invention will be described next.

Figure 28:
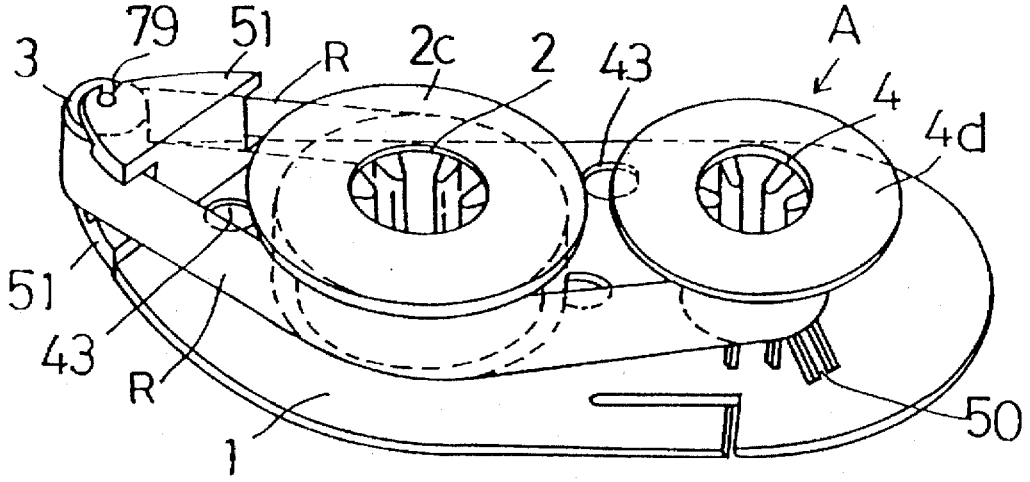
FIG. 28 is a perspective view showing a ribbon cassette for use in the apparatus shown in FIG. 26, FIG. 29(*a*) is a section view of a film transfer roller for use in the apparatus shown in FIG. 26, FIG. 29(*b*) is a side view of the film transfer roller for use in the apparatus of FIG. 26.

With a film transfer apparatus relating to this embodiment, as shown in FIG. 28, a film transfer ribbon R including a pressure sensitive adhesive film (a) (about 20 um in thickness) as one example of the transfer film, attached to one side of a resin base film (b) (about 25 um in thickness) as one example of a flexible base, is entrained about and between a feed core 2 made of resin and having a flange 2*c* and a take-up core 4 made of resin and having a flange 4*d*, with the side of the adhesive film (a) of the ribbon being oriented outside. The respective cores 2, 4 are supported to a plate-like support member 1 made of resin and also a film transfer roller 4 for transferring an adhesive film (a) of a film transfer ribbon R fed from the feed core 2 on to an object surface B such as a paper surface by pressing the ribbon against the object surface is rotatably supported to the support member 1. The assembly of these components together constitute a film transfer ribbon cassette A to be attached within the apparatus casing C.

The plate-like support member 1 has an outer configuration substantially corresponding to the configuration the inner peripheral face of the apparatus casing C within which the member 1 is to be attached. And, the support member 1 rotatably supports the cores 2, 4 through one end thereof and integrally forms a through hole 43 for engagement with a projection 42 of the apparatus casing C for fixedly positioning this support member 1 relative to the casing C, a pawl 50 for restricting reverse rotation of the take-up core 4, and a pair of right and left restricting members 51 having a triangular plate-like shape and adapted for restricting widthwise displacement of the ribbon R passing the transfer roller 3. And, opposed ends, in the ribbon width direction, (the opposed ends in the direction of the rotational axis) of the transfer roller 3 are rotatably supported to the right and left restricting members 51. Further, a portion of the film transfer ribbon R extending between the feed core 2 and the take-up core 4 is entrained about the transfer roller 3.

Figure 26:
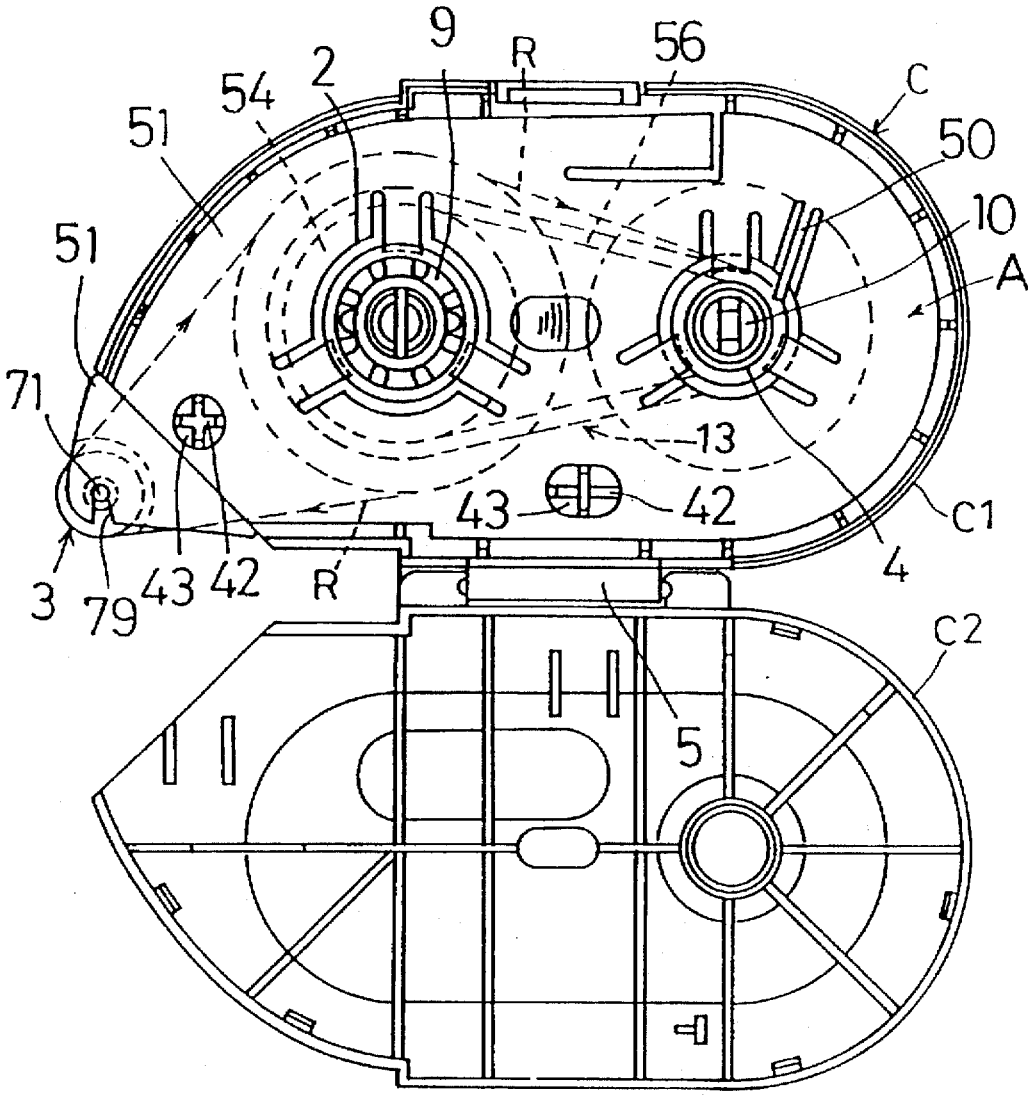
FIG. 26 is a plan view showing a film transfer apparatus relating to a still further embodiment of the invention under a condition in which a holder of the apparatus is opened.
Figure 27:
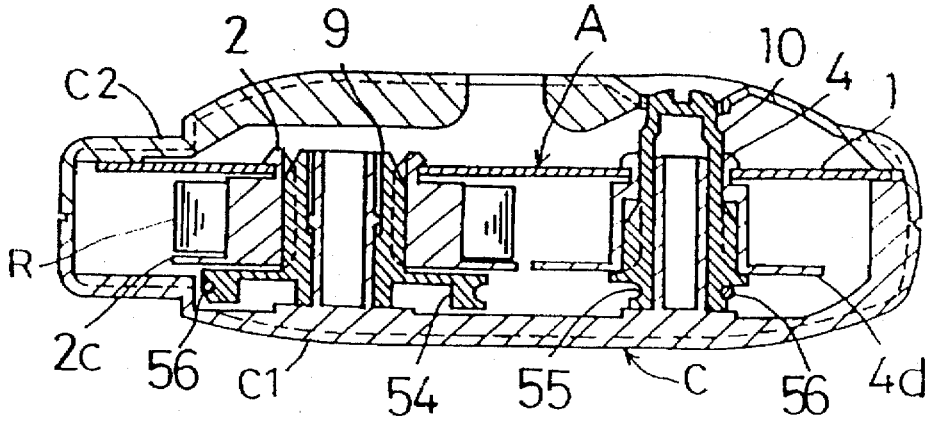
FIG. 27 is a section view showing major portions of the apparatus shown in FIG. 26.

FIGS. 26 and 27 illustrate the film transfer apparatus under the condition where the film transfer ribbon cassette A having the above-described construction is detachably attached within the apparatus casing C. The apparatus casing C includes two separate case portions C1, C2 divided into two in the ribbon width direction and pivotably joined to each other via a hinge portion 5 to be opened and closed relative to each other. The one case portion C1 rotatably supports a feed-core support shaft 9 on which an axial hole of the feed core 2 is to be fitted, and a take-up core support shaft 10 on which an axial hole of the take-up core 4 is to be fitted. Further, a slip coupling mechanism 13 is provided for allowing the take-up core 4 rotatably mounted on the take-up core support shaft 10 and the feed core 2 rotatably mounted on the feed-core support shaft 9 to rotate in such a manner that the take-up core 4 is rotated in a take-up speed higher than a feeding speed provided by the rotation of the feed core 2 and also that the rotation of the feed core 2 and the rotation of the take-up core 4 are slippably coupled with each other.

The slip coupling mechanism 13 includes a first pulley 84 formed integrally with one axial end of the feed-core support shaft 9, a second pulley 55 formed integrally with one axial end of the take-up core support shaft 10, and a loop of rubber transmission belt 56 entrained about the first pulley 54 and the second pulley 55. The second pulley 55 has a smaller diameter than the first pulley 54 so as to cause the take-up core 4 to provide the ribbon take-up speed faster than the ribbon feeding speed of the feed core 2 even when the diameter of the ribbon R coiled about the feed core 2 becomes smaller; and also slippage occurring between the transmission belt 56 and the second pulley 55 allows slippage between the rotation of the feed core 2 and the rotation of the take-up core 4, thereby absorbing the difference between the ribbon feeding speed and the ribbon take-up speed.

After the apparatus casing C is opened and the projection 42 formed on the one case portion C1 is fitted into the through hole 48 of the plate-like support member 1, the film transfer ribbon cassette A may be fixedly positioned relative to the the case portion C1. Then, the respective support shafts 9, 10 are fitted into the free ends of the cores 2, 4, thus attaching the ribbon cassette A to the case portion C1 and then the other case portion C2 is pivotably closed, whereby the apparatus casing C is closed. After this, as the transfer roller 3 is rotated to the upstream side in the ribbon feeding direction of the feed core 2 while the adhesive film (a) of the ribbon R is pressed against the object surface B, the film transfer ribbon R is fed in association with the rotation of the feed core 2. As a result, the adhesive film (a) is transferred on to the object surface B and at the same time the used ribbon R is taken up on to the take-up core 4 with the adhesive film (a) of the ribbon R being loosely adhered thereto.

Figure 29:
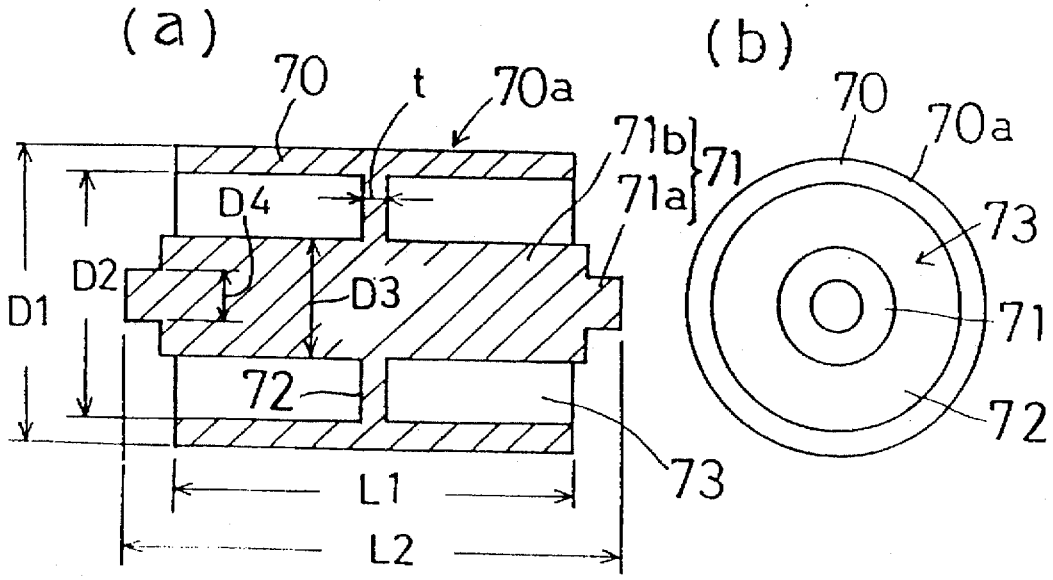
Figure 30:
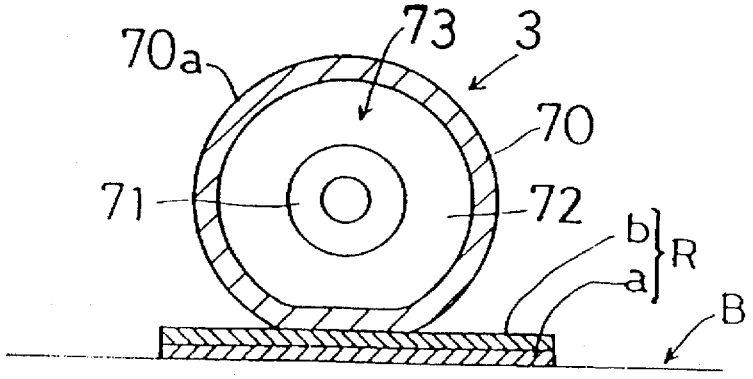
FIG. 30 is a side view illustrating a one-sided contact condition of the film transfer roller used in the apparatus of FIG. 26, FIG. 31(*a*) is a section view showing a film transfer roller relating to a still further embodiment of the invention, FIG. 31(*b*) is a side view of the film transfer roller, FIG. 32(*a*) is a partially cutaway plan view of a film transfer roller relating to a still further embodiment of the invention, FIG. 32(*b*) is a side view of the film transfer roller shown in FIG. 32(*a*), FIG. 33(*a*) is a partially cutaway plan view of a film transfer roller relating to a still further embodiment of the invention, FIG. 33(*b*) is a side view of the film transfer roller shown in FIG. 33(*a*), FIG. 34(*a*) is a section view of a film transfer roller relating to a still further embodiment of the invention, FIG. 34(*b*) is a side view of the film transfer roller shown in FIG. 34(*a*), FIG. 35(*a*) is a section view of a film transfer roller relating to a still further embodiment of the invention, FIG. 35(*b*) is a side view of the film transfer roller shown in FIG. 35(*a*)

As shown in FIGS. 29(*a*), (*b*) and FIG. 30, the transfer roller 3 includes a cylindrical roller portion 70 rotatable while pressing the back face of the film base (b) for transferring the adhesive film (a) of the base (b) on to the object surface B, a circular-shaft-like support portion 71 for rotatably supporting the roller portion 70 at grooved bearing portions 79 formed in the right and left restricting members 51, and an annular connecting portion 72 for coaxially joining the above portions 70, 71. And, these portions 70, 71 and 72 are formed integrally with each other of thermoplastic resin such as polyethylene, polypropylene, elastomer, polyacetal or the like.

Between an inner peripheral face of the roller portion 70 and an outer peripheral face of the support portion 71, there is formed an annular space 73 extending continuously along a roller face 70*a* of the roller portion 70 and opened to the opposed sides in the direction of rotational axis. As a result, of the roller face 70*a* of the roller portion 70, a roller face portion excluding those portions joined with the connecting portion 72 and portions adjacent thereto is rendered elastically deformable in the radially inward direction, i.e. into the annular space 73.

Reduced-diameter shaft portions 71*a* formed at opposed ends of the support portion 71 are rotatably fitted within the grooved bearing portions 79 described above.

Followings are sample dimensions of the above-described respective portions of the transfer roller 3. The roller portion 70 has an outer diameter D1 of 9 mm, an inner diameter D2 of 7.6 mm, and a rotational axial length L1 of 12 mm. The support portion 71 has an outer diameter D3 of 3.6 mm for the larger diameter portion 71*b*, an outer diameter D4 of 2 mm for the reduced diameter portions 71*a* and a rotational axial length L2 of 15 mm. Further, the connecting portion 72 has a thickness (t) of 0.7 mm.

In transferring the ahdesive film (a) of the ribbon R onto the object surface B, the apparatus casing C may be slightly inclined in the ribbon width direction, so that the ribbon R contacting the roller face 70*a* of the transfer roller 3 may be also inclined in the ribbon width direction relative to the object surface B. This is referred to as the one-sided contact phenomenon. In such case, however, if the pressing force is continuously applied to the transfer roller 3 under this condition, the one-sided contacting portion of the roller face 70*a* of the roller portion 70 is elastically deformed in the radially inward direction, whereby the entire adhesive film (a) of the ribbon R contacting the pressed portion of the roller face 70*a* may be pressed against the object surface B. As a result, transfer failure due to such one-sided contact phenomenon may be restricted.

Incidentally, in the case of the above embodiment, the amount of the elastic deformation is at maximum at the opposed axial ends of the roller portion 70. On the other hand, because of the presence of the connecting portion 72, the amount of elastic deformation is substantially zero at the axially central portion of the roller portion 70.

However, in the film transfer operation, the user will tend to move the apparatus casing C so as to orient the ribbon R contacting the roller face 70*a* of the transfer roller 3 parallel with the object surface B. For this reason, even if the above-described one-sided contact phenomenon occurs, the angle of inclination relative to the object surface B in the ribbon width direction will likely be kept within a very limited range. Then, even if the amount of elastic deformation may be substantially zero at the axially central portion of the roller portion 70 as described above, the entire transfer film (a) of the ribbon R may be pressed against the object surface B by utilizing the elastic deformation of this film transfer ribbon per se.

Figure 31:
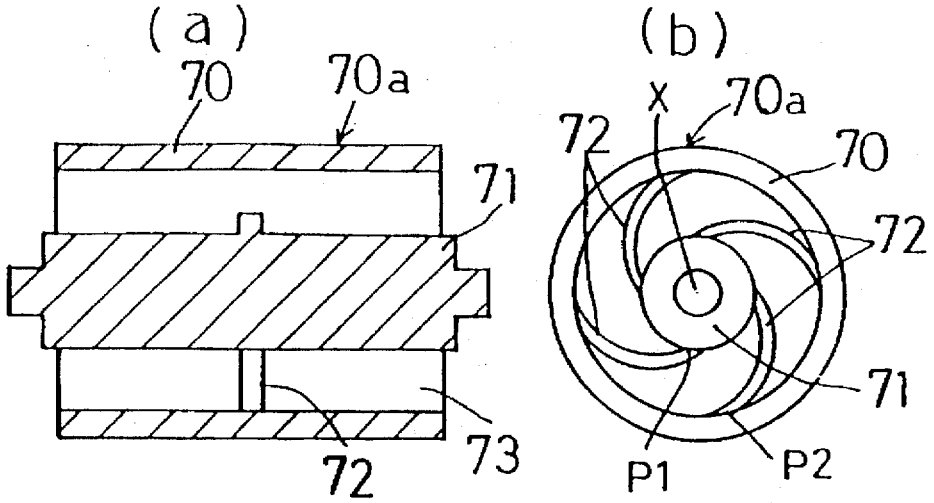

(23) FIGS. 31(*a*) and (*b*) show a further embodiment relating to the film transfer roller 3.

In the case of the film transfer roller 3 according to this embodiment, the connecting portion 72 includes a plurality of bar-like connecting members for connecting the inner peripheral face of the roller portion 70 with the outer peripheral face of the support portion 71 at a plurality of positions (four positions in this particular embodiment) in the rotational direction. And, each of these connecting members 72 has an arcuate shape such that a connecting position P2 to the roller portion 70 is displaced to one side in the rotational direction, i.e. to the downstream side in the rotational direction, relative to a line drawn between a connecting position P1 to the support portion 71 and the rotational axis X.

In the case of this embodiment, when a pressing force is applied to the roller portion 70 for a film transfer, the connecting portion 72 coaxially joining the roller portion 70 and the support portion 71, too may be elastically deformed in the radially inward direction. As a result, the film transfer failure due to the one-sided contact phenomenon may be more effectively restricted.

Figure 32:
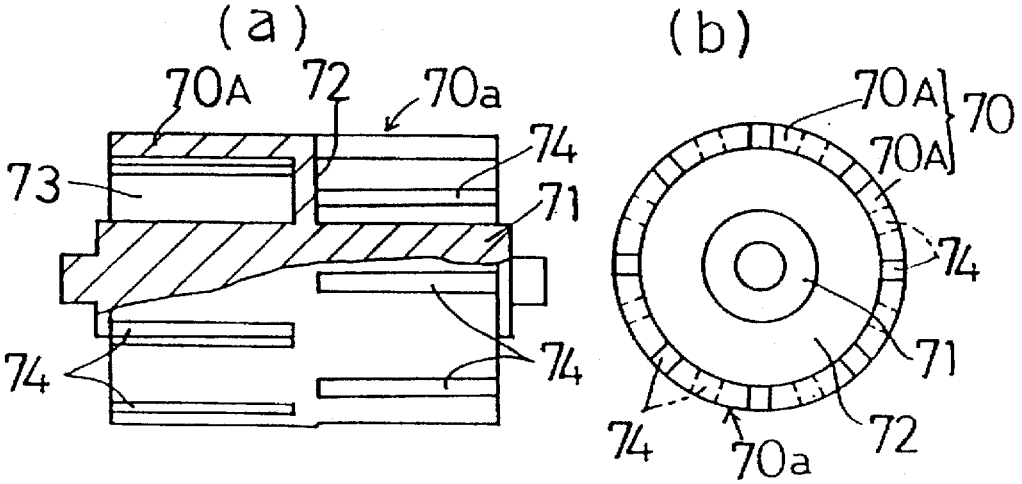

(24) FIGS. 32(*a*) and (*b*) show a still further embodiment relating to the film transfer roller 3.

In this embodiment, at those axially opposed end portions of the roller portion 70 excluding the portions connected to the connecting portion 72 and portions adjacent thereto and at each of a plurality of positions (eight positions in this particular embodiment) spaced from each other with a predetermined rotational pitch therebetween, there is formed an axially extending slit 74. And, the slit 74 formed on one axial side is displaced by half a pitch relative to the slit 74 formed on the other axial side. So that, each roller segment 70A formed between the slits 47 adjacent each other in the rotational direction is rendered elastically deformable in the radially inward direction.

Accordingly, with the construction of this embodiment, the plurality of roller segments 70A constituting the roller portion 70 are spaced from each other due to the interposition of the slits 74 extending in the axial direction. So that, the amount of the radially inward elastic deformation of the roller segment 70A located at a film transferring position will not be limited by the rotationally adjacent roller segments 70A. Accordingly, in comparison with a construction where the roller face 70*a* of the roller portion 70 is constructed as a face extending continuously in the rotational direction, the radially inward elastic deformation will occur by a larger amount with application of a same amount of pressing force. Accordingly, a film transfer failure due to the one-sided contact phenomenon may be effectively restricted.

Figure 33:
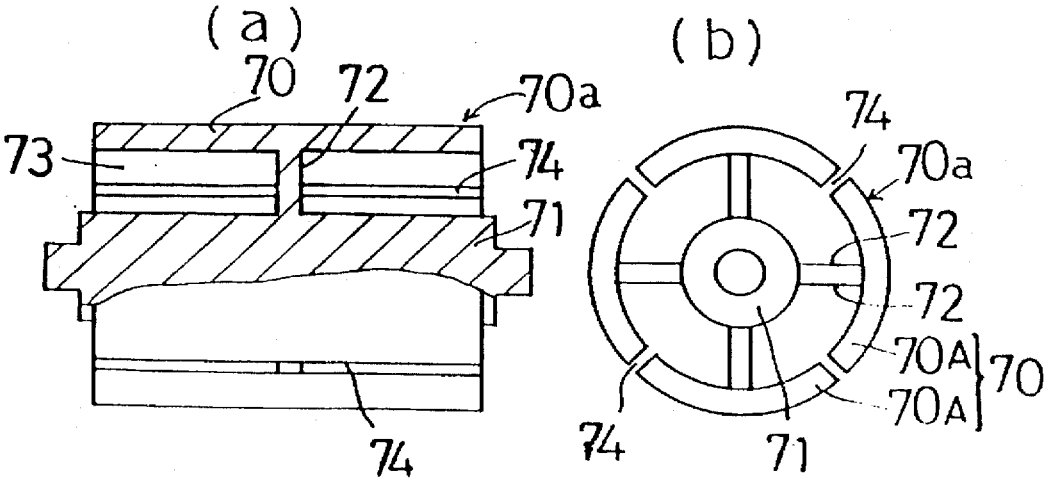

(25) FIGS. 33(*a*) and (*b*) show a still further embodiment relating to the film transfer roller 3.

In this case, the connecting portion 72 includes a plurality of bar-like connecting members for joining the inner peripheral face of the roller portion 70 and the outer peripheral face of the support portion 71 at a plurality of rotational positions (four positions in this particular embodiment). Each of these connecting members 72 extends straight in the radial direction; and between the connecting members 72 of the roller portion 70 adjacent each other in the rotational direction, a slit 74 is formed to extend from one axial end of the roller portion 70 to the other axial end of the same. Further, each roller segment 70A formed between the rotationally adjacent slits 74 is rendered elastically deformable in the radially inward direction.

With the above-described construction of this embodiment, of the roller face 70*a* of the roller portion 70, the face portion corresponding to the center between the rotationally adjacent connecting members 72 is allowed to be elastically deformed in the radially inward direction. Moreover, the plurality of roller segments 70A constituting the roller portion 70 are spaced from each other due to the interposition of the slits 74 extending in the axial direction. So that, the amount of the radially inward elastic deformation of the roller segment 70A located at a film transferring position will not be limited by the rotationally adjacent roller segments 70A.

As a result, in comparison with a construction where the connecting portion 72 for coaxially joining the roller portion 70 and the support portion 71 is formed like an annular plate extending continuously in the rotational direction, the radially inward elastic deformation of the portion of the roller portion 70 to which this connecting portion 72 is joined may be promoted. Further, in comparison with the construction where the roller face 70*a* of the roller portion 70 is constructed as a face extending continuously in the rotational direction, the radially inward elastic deformation will occur by a larger amount with application of a same amount of pressing force. With these effects combined, a film transfer failure due to the one-sided contact phenomenon may be more effectively restricted.

Figure 34:
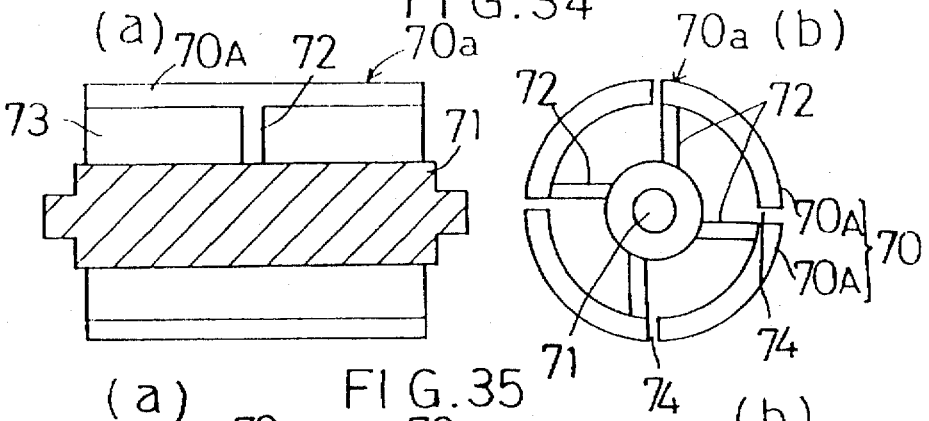

(26) FIGS. 34(*a*) and (*b*) show a still further embodiment relating to the film transfer roller 3.

In this case, the connecting portion 72 includes a plurality of bar-like connecting members for joining the inner peripheral face of the roller portion 70 and the outer peripheral face of the support portion 71 at a plurality of rotational positions (four positions in this particular embodiment). Each of these connecting members 72 extends straight in the radial direction; and at each portion of the roller portion 70 on one side in the rotational direction of each connecting member 72, a slit 74 is formed to extend from one axial end of the roller portion 70 to the other axial end of the same.

The construction of this embodiment achieves the function and effects described in the above embodiments; and also since the connecting member 72 is provided on one side in the rotational direction adjacent the roller segment 70A spaced by the slit 74, this roller segment 70A may be elastically deformed in the radially inward direction by a large amount. As a result, a film transfer failure due to the one-sided contact phenomenon may be more effectively restricted.

Figure 35:
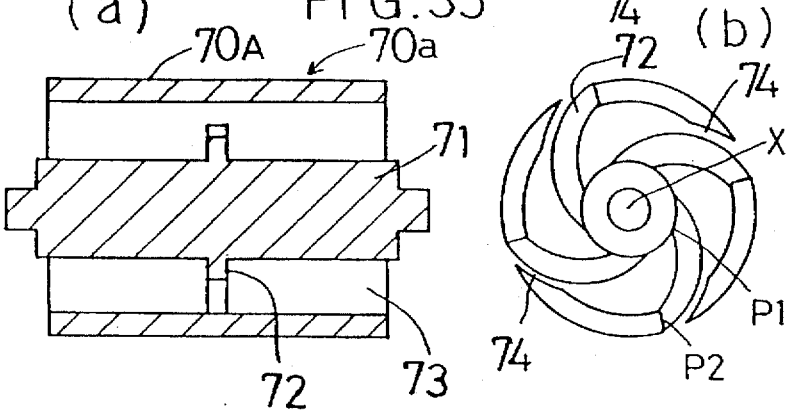

(27) FIGS. 35(*a*) and (*b*) show a further embodiment relating to the film transfer roller 3.

In the case of the film transfer roller 3 according to this embodiment, the connecting portion 72 includes a plurality of bar-like connecting members for connecting the inner peripheral face of the roller portion 70 with the outer peripheral face of the support portion 71 at a plurality of positions (four positions in this particular embodiment) in the rotational direction. And, each of these connecting members 72 has an arcuate shape such that a connecting position P2 to the roller portion 70 is displaced to one side in the rotational direction, i.e. to the downstream side in the rotational direction, relative to a line drawn between a connecting position P1 to the support portion 71 and the rotational axis X. Further, at each portion of the roller portion 70 on one side in the rotational direction of each connecting member 72, a slit 74 is formed to extend from one axial end of the roller portion 70 to the other axial end of the same.

The construction of this embodiment achieves the function and effects described in the above embodiments. In addition, since the connecting portion 72 coaxially connecting between the roller portion 70 and the support portion 71, may also be elastically deformed in the radially inward direction. So that, there occurs radially inward elastic deformation also at the roller face portion of the roller portion 70 to which this connecting portion 72 is joined, i.e. the roller face portion located centrally in the rotational direction. Consequently, the film transfer failure due to the one-sided contact phenomenon may be more effectively restricted.

Figure 36:
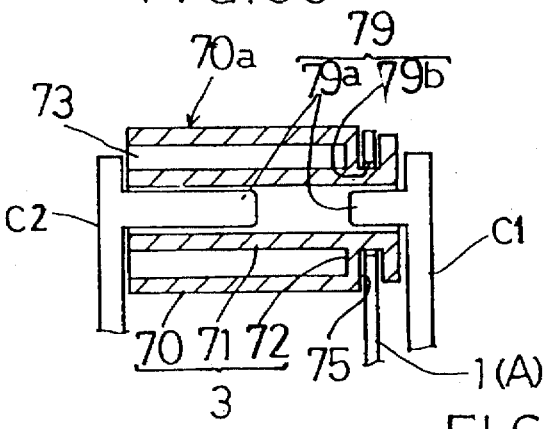
FIG. 36 is an enlarged section view showing an attaching portion of a film transfer roller relating to a sill further embodiment of the invention.

(28) As shown in FIGS. 1 and 36, the film transfer roller 3 may be supported to the ribbon cassette A and to the apparatus casing C.

The transfer roller 3 includes a cylindrical roller portion 70, a cylindrical support portion 71 to be fitted on round-shaft-like bearing projections 79 formed on opposing inner faces of the case portions C1, C2 of the apparatus casing C and an annular plate-like connecting portion 72 for coaxially joining the above portions 70, 71 at one axial end thereof. And, these portions 70, 71 and 72 are formed integrally with each other of thermoplastic resin such as polyethylene, polypropylene, elastomer, polyacetal or the like. Between an inner peripheral face of the roller portion 70 and an outer peripheral face of the support portion 71, there is formed a circular annular space 73 extending continuously along a roller face 70*a* of the roller portion 70 and opened to the opposed sides in the direction of rotational axis. As a result, of the roller face 70*a* of the roller portion 70, a roller face portion excluding those portions joined with the connecting portion 72 and portions adjacent thereto is rendered elastically deformable in the radially inward direction, i.e. into the annular space 73.

One end portion of the support portion 71 projects outward in the rotational axis direction relative to the roller portion 70 and at its projecting leading end thereof, there is formed an annular groove 75 which is to be rotatably fitted with a bearing groove 79*b* formed in the plate-like support member 1 of the ribbon cassette A.

The bearing portion 79 for rotatably supporting the support portion 71 of the transfer roller 3 includes a pair of bearing projections 79*a* formed on the case portions C1, C2 and the bearing groove 79*b* formed as a cutout in the plate-like support member 1 of the film transfer ribbon cassette A.

That is, the film transfer roller 3 is first supported at one end thereof at the bearing groove 79*b* of the ribbon cassette A; and then when this ribbon cassette A is attached to a predetermined position within the apparatus casing C, the both opposed ends of the roller 3 are rotatably supported by the pair of bearing projections 79*a* of this apparatus casing C.

Figure 37:
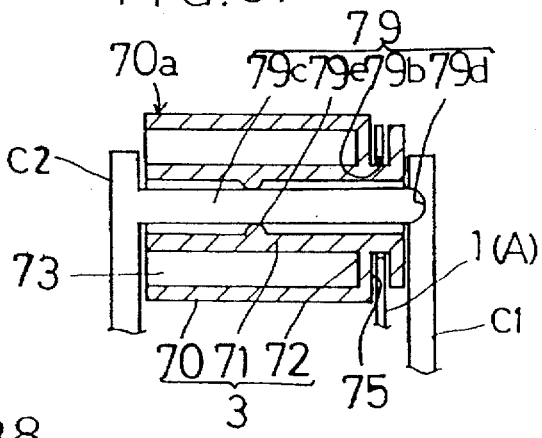
FIG. 37 is an enlarged section view showing an attaching portion of a film transfer roller relating to a sill further embodiment of the invention.

(29) FIG. 37 shows a still further embodiment of the invention.

In this embodiment, the bearing portion 79 for rotatably supporting the support portion 71 of the film transfer roller 3 includes a round-shaft-like bearing projection 79*c* formed on one of the opposing inner faces of the case portions C1, C2, a concave portion 79*d* formed in the other inner face for engagement with a leading end of the bearing projection 79*c* and a bearing groove 79*d* formed in the plate-like support member 1 of the film transfer ribbon cassette A.

At an axially center position on the inner peripheral face of the support portion 71 of the film transfer roller 3, there is integrally formed an annular pivot projection 79*e* for contact with the outer peripheral face of the bearing projection 79*c*. Then, with respect to this contact position as a pivot, the film transfer roller 3 may be supported to be pivotable within a predetermined range (the extension until the axial end of the inner peripheral face of the support portion 71 comes into contact with the outer peripheral face of the bearing projection 79*c*).

In the case of the construction of this embodiment, the film transfer roller 3 per se is rendered pivotable with the predetermined range with respect to the contact position to the annular pivot projection 79*e* as the pivot. Further, of the roller face 70*a* of the roller portion 70, a roller face portion excluding those portions joined with the connecting portion 72 and portions adjacent thereto is rendered elastically deformable in the radially inward direction, i.e. into the circular annular space 73. Consequently, film transfer failure due to the one-sided contact phenomenon may be more effectively restricted.

Incidentally, although in this embodiment the annular pivot projection 79*e* for contacting the outer peripheral face of the bearing projection 79*c* is formed integrally with the inner peripheral face of the support portion 71 of the film transfer roller 3, this annular pivot projection 79*e* may be formed instead integrally with the outer peripheral face of the bearing projection 79*c* so that its leading end comes into contact with the inner peripheral face of the support portion 71 of the film transfer roller 3.

Further alternatively, the annular pivot projection 79*e* may be formed separately from the support portion 71 of the roller 3 or from the bearing projection 79*c*. Then, this separate projection 79*e* may be attached to either the support portion 71 or to the bearing projection 79*c*.

The other portions of the construction of this embodiment are the same as those of the foregoing embodiment and therefore these portions are provided with the same reference numerals and marks and will not be described here.

Figure 38:
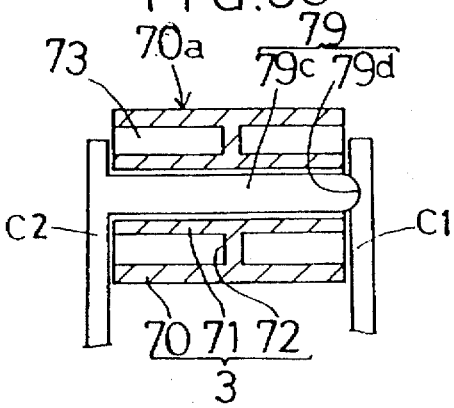
FIG. 38 is an enlarged section view showing an attaching portion of a film transfer roller relating to a sill further embodiment of the invention.
Figure 39:
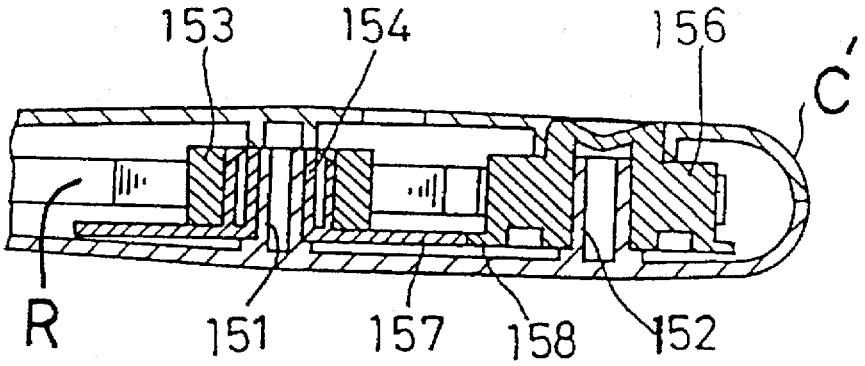
FIG. 39 (PRIOR ART)
FIG. 39 is a section view showing major portions of a conventional film transfer apparatus.
Figure 40:
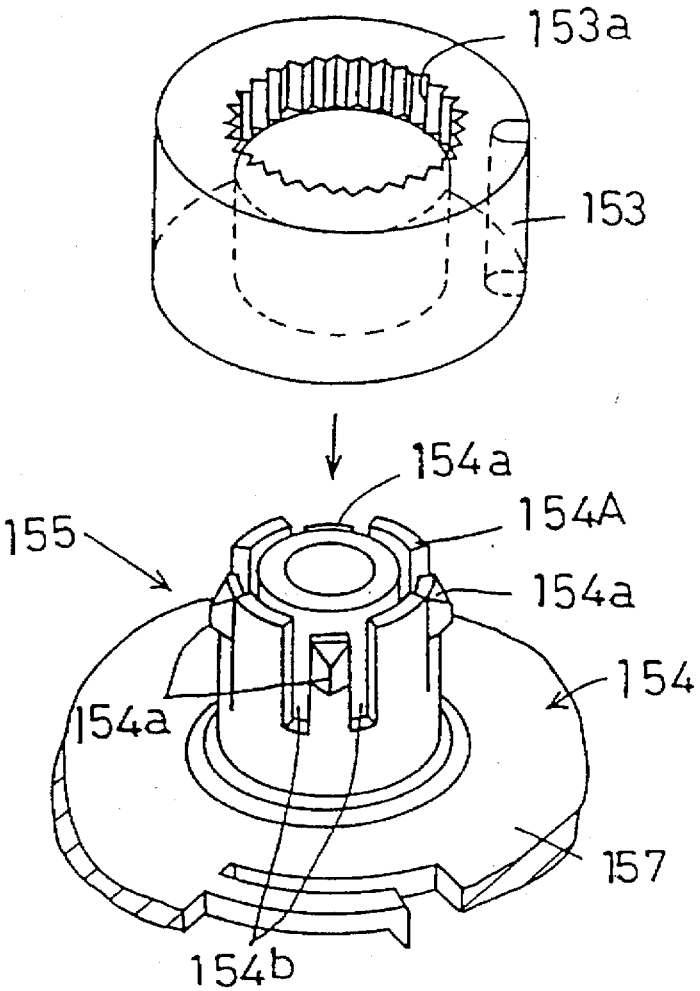
FIG. 40 (PRIOR ART)
FIG. 40 is an enlarged exploded perspective view showing a feed core of the apparatus shown in FIG. 39.

(30) In the foregoing embodiments, the support portion 71 of the film transfer roller 3 is supported to either the plate-like support member 1 of the film transfer ribbon cassette A or to both the support member 1 and the case portions C1, C2 of the apparatus casing C. Instead, as shown in FIG. 38, the support portion 71 of the transfer roller 3 may be supported only to the apparatus casing C.

More particularly, the bearing portion 79 for rotatably supporting the support portion 71 of the film transfer roller 3 may be comprised of the bearing projection 79*c* formed on one of the opposing inner faces of the case portions C1, C2 and the concave portion 79*d* formed on the other inner face for engagement with the leading end of the bearing projection 79*c*.

Incidentally, the film transfer roller 3 per se is comprised of the cylindrical roller portion 70 and the cylindrical support portion 71 and the circular annular plate-like connecting portion 72 for coaxially connecting the portions 70, 71 at the center position in the rotational axis direction, with these portions 70, 71, 72 being formed integrally with each other of thermoplastic resin such as polyethylene, polypropylene, elastomer, polyacetal or the like. Between an inner peripheral face of the roller portion 70 and an outer peripheral face of the support portion 71, there is formed a circular annular space 73 extending continuously along a roller face 70*a* of the roller portion 70 and opened to the opposed sides in the direction of rotational axis. As a result, of the roller face 70*a* of the roller portion 70, a roller face portion excluding those portions joined with the connecting portion 72 and portions adjacent thereto is rendered elastically deformable in the radially inward direction.

(31) In the foregoing embodiments, the roller portion 70 is formed as a substantially cylindrical member segmented by means of the slits 74. However, the shape of this portion is not limited to such cylindrical or substantially cylindrical one, but may be a polygonal prism shape having a polygonal cross section similar to a circular cross section.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A film transfer apparatus, comprising:

a film transfer ribbon having a transfer film on one side thereof;

a transfer head;

a feed core about which the film transfer ribbon is entrained such that the transfer film is oriented outwardly;

a take-up core for taking up the film transfer ribbon fed from the feed core past the transfer head; a take-up core support shaft;

an apparatus casing for replaceably accommodating therein the feed core and the take-up core, the casing including at least one of a feed core support shaft for rotatably mounting the feed core with the feed core dismountable in a direction of width of the ribbon and said take-up core support shaft for rotatably mounting the take-up core with the take-up core dismountable in the direction of the ribbon width;

a pair of transmission means provided respectively to the feed core support shaft and the take-up core support shaft for causing the take-up core to provide a ribbon take-up speed higher than a ribbon feeding speed provided by the feed core; and a slip coupling mechanism for slippably coupling between rotation of the take-up core and rotation of the feed core;

wherein, in response to movement of the transfer head from an upstream side in a ribbon feeding direction of the feed core with the transfer head pressing the film transfer ribbon against an object surface, the feed core is rotated to continuously feed the film transfer ribbon while a portion of the ribbon is taken up the take-up core;

an engaged portion formed in an inner peripheral engaging surface of the take-up core for engagement with an engaging portion formed in an outer peripheral engaging surface of the take-up core support shaft is rendered elastically deformable to a non-transmitting position responsive to a relative rotational force exceeding a predetermined level applied thereto with this elastically deformable engaging portion constituting said slip coupling mechanism; and the engaged portion of the take-up core is provided with a mechanical strength lower than the engaging portion of the take-up core support shaft.

2. A film transfer apparatus as defined in claim 1, wherein the feed core and the take-up core are included in the casing and are rotatably supported by a substantially planar support member; the apparatus casing includes two separate case members detachably attached to each other in a direction of width of the film transfer ribbon; and each of the case members includes a reinforcing rib for contacting the support member introduced between the case members to restrict movement of the support member in the direction of ribbon width.

3. A film transfer apparatus as defined in claim 1, wherein the apparatus casing includes a case body portion and a case lid portion which are pivotal relative to each other via a hinge portion in the direction of ribbon width, the apparatus further comprising a lock member for releasably locking the two case portions in a closed position.

4. A film transfer apparatus as defined in claim 3, wherein the two case portions have peripheral walls with opened ends, wherein the two case portions and the hinge portion are formed integrally with each other, and the opened ends of the peripheral walls of the respective case portions include engagement regulating portions engageable with each other in the ribbon width direction when the two case portions are pivotably closed, so as to restrict relative movement between the peripheral walls along a width thereof.

5. A film transfer apparatus as defined in claim 4, wherein the peripheral wall of one of the case portions integrally forms a guiding projection for guiding the peripheral wall of the other case portion to a position of engagement between the engagement regulating portions when the two cases are pivotably closed.

6. A film transfer apparatus comprising:

a film transfer roller;

a film transfer ribbon having a transfer film on one side thereof;

a transfer head defined by the film transfer roller;

a feed core about which the film transfer ribbon is entrained such that the transfer film is oriented outwardly;

a take-up core for taking up the film transfer ribbon fed from the feed core past the transfer head; a take-up core support shaft;

an apparatus casing for replaceably accommodating therein the feed core and the take-up core, the casing including at least one of a feed core support shaft for rotatably mounting the feed core with the feed core dismountable in a direction of width of the ribbon and said take-up core support shaft for rotatably mounting the take-up core with the take-up core dismountable in the direction of the ribbon width;

a pair of transmission means provided respectively to the feed core support shaft and the take-up core support shaft for causing the take-up core to provide a ribbon take-up speed higher than a ribbon feeding speed provided by the feed core; and a slip coupling mechanism for slippably coupling between rotation of the take-up core and rotation of the feed core, wherein, in response to movement of the transfer head from an upstream side in a ribbon feeding direction of the feed core with the transfer head pressing the film transfer ribbon against an object surface, the feed core is rotated to continuously feed the film transfer ribbon while a portion of the ribbon is taken up about the take-up core, wherein an engaged portion formed in an inner peripheral engaging surface of the take-up core for engagement with an engaging portion formed in an outer peripheral engaging surface of the take-up core support shaft is rendered elastically deformable to a non-transmitting position responsive to a relative rotational force exceeding a predetermined level applied thereto, with this elastically deformable engaging portion constituting the slip coupling mechanism; and the engaged portion of the take-up core is provided with a mechanical strength lower than the engaging portion of the take-up core support shaft.

* * * * *

UNITED STATES PATENT AND TRADEMARK OFFICE

CERTIFICATE OF CORRECTION

PATENT NO. : 5,685,944
DATED : November 11, 1997
INVENTOR(S) : Masahisa Nose et al.

It is certified that error appears in the above-identified patent and that said Letters Patent is hereby corrected as shown below:

Column 4 Line 27 "tooth. the" should read --tooth, the--.

Column 5 Line 3 "in the form of box" should read --in the form of a box--.

Column 5 Line 37 "take-up cope" should read --take-up core--.

Column 5 Line 63 "so be opened" should read --to be opened--.

Column 6 Line 15 "gab between" should read --gap between--.

Column 9 Line 6 "sill further" should read --still further--.

Column 9 Line 57 "sill further" should read --still further--.

Column 9 Line 60 "sill further" should read --still further--.

Column 9 Line 63 "sill further" should read --still further--.

Column 10 Line 33 "first attaching hole la" should read --first attaching hole 1a-- (bold).

Column 12 Line 16 "there stress" should read --where stress--.

Column 12 Line 31 "materiel" should read --material--.

Column 16 Line 5 "hinge portion 8" should read --hinge portion 5--.

Column 16 Line 9 "portion 8" should read --portion 6--.

Column 16 Line 14 "head support portion 28" should read --head support portion 25--.

Column 16 Line 64 "constitutes" should read --constitute--.

UNITED STATES PATENT AND TRADEMARK OFFICE

CERTIFICATE OF CORRECTION

PATENT NO. : 5,685,944
DATED : November 11, 1997
INVENTOR(S) : Masahisa Nose et al.

It is certified that error appears in the above-identified patent and that said Letters Patent is hereby corrected as shown below:

Column 20 Line 14 "relative the" should read --relative to the--.

Column 20 Lines 32-33 "projection ridge 62" should read --projecting ridge 62--.

Column 21 Line 8 "the the" should read --the--.

Column 21 Line 55 "type. The" should read --type, the--.

Column 22 Line 5 "(about 20 um" should read --(about 20μm--.

Column 22 Line 7 "25 um" should read --25 μm--.

Column 22 Line 22 after "configuration" insert --of--.

Column 22 Line 59 "pulley 84" should read --pulley 54--.

Column 23 Line 10 "through hole 48" should read --through hole 43--.

Column 23 Line 12 "to the the case" should read --to the case--.

Column 23 Line 42 after "As a result" delete comma --,--.

Column 23 Line 51 "Followings" should read --Following--.

Column 23 Line 60 "ahdesive" should read --adhesive--.

Column 24 Line 45 after "support portion 71" delete comma --,--.

Column 26 Line 25 after "addition," delete --since--.

Column 26 Line 26 after "portion 71" delete comma --,--.

UNITED STATES PATENT AND TRADEMARK OFFICE

CERTIFICATE OF CORRECTION

PATENT NO. : 5,685,944

DATED : November 11, 1997

INVENTOR(S) : Masahisa Nose et al.

It is certified that error appears in the above-identified patent and that said Letters Patent is hereby corrected as shown below:

Column 26 Line 50 after "As a result" delete comma --,--.

Column 26 Line 58 after "thereof" delete comma --,--.

Column 28 Line 15 after "As a result" delete comma --,--.

Claim 1 Column 28 Line 66 after "taken up" insert --about--.

Signed and Sealed this

Thirty-first Day of March, 1998

*Attest:*

*Attesting Officer*

Bruce Lehman

BRUCE LEHMAN

*Commissioner of Patents and Trademarks*